US005955185A

United States Patent [19]

Yoshino et al.

[11] Patent Number: 5,955,185

[45] Date of Patent: Sep. 21, 1999

[54] RECORDING MEDIUM, AND AN IMAGE FORMING METHOD USING THE MEDIUM

[75] Inventors: Hitoshi Yoshino, Zama; Yuji Kondo, Machida; Hiroshi Tomioka, Matsudo, all of Japan

[73] Assignee: Canon Kabushiki Kaisha, Tokyo, Japan

[21] Appl. No.: 08/667,865

[22] Filed: Jun. 20, 1996

[30] Foreign Application Priority Data

Jun. 23, 1995 [JP] Japan ..... 7-157457
May 21, 1996 [JP] Japan ..... 8-125768

[51] Int. Cl.[6] ..... B41M 5/00; B41J 2/01

[52] U.S. Cl. ..... 428/304.4; 347/105; 428/195; 428/328

[58] Field of Search ..... 428/195, 304.4, 428/328; 347/105

[56] References Cited

U.S. PATENT DOCUMENTS

| | | | |
|---|---|---|---|
| 4,202,870 | 5/1980 | Weber et al. | 423/630 |
| 4,242,271 | 12/1980 | Weber et al. | 260/448 AD |
| 4,879,166 | 11/1989 | Misuda et al. | 428/212 |
| 5,104,730 | 4/1992 | Misuda et al. | 428/304.4 |
| 5,605,750 | 2/1997 | Romano et al. | 428/304.4 |

FOREIGN PATENT DOCUMENTS

| | | |
|---|---|---|
| 622244A1 | 11/1994 | European Pat. Off. . |
| 709222A1 | 5/1996 | European Pat. Off. . |
| 709223A1 | 5/1996 | European Pat. Off. . |
| 736392A1 | 10/1996 | European Pat. Off. . |
| 51-38298 | 3/1976 | Japan . |
| 52-53012 | 4/1977 | Japan . |
| 53-49113 | 5/1978 | Japan . |
| 54-59936 | 5/1979 | Japan . |
| 55-11829 | 1/1980 | Japan . |
| 55-5830 | 1/1980 | Japan . |
| 55-51583 | 4/1980 | Japan . |
| 55-144172 | 11/1980 | Japan . |
| 55-146786 | 11/1980 | Japan . |
| 56-120508 | 9/1981 | Japan . |
| 58-110287 | 6/1983 | Japan . |
| 60-61286 | 4/1985 | Japan . |
| 60-137685 | 7/1985 | Japan . |
| 60-232990 | 11/1985 | Japan . |
| 60-245588 | 12/1985 | Japan . |
| 61-3777 | 1/1986 | Japan . |
| 62-174182 | 7/1987 | Japan . |
| 62-264988 | 11/1987 | Japan . |
| 1-97678 | 4/1989 | Japan . |
| 2-276670 | 11/1990 | Japan . |
| 4-202011 | 7/1992 | Japan . |
| 4-267180 | 9/1992 | Japan . |
| 5-16517 | 1/1993 | Japan . |
| 5-24335 | 2/1993 | Japan . |
| 5-32414 | 2/1993 | Japan . |
| 5-16015 | 3/1993 | Japan . |
| 6-297831 | 10/1994 | Japan . |

OTHER PUBLICATIONS

S. Brunauer, et al., "Adsorption of Gases in Multimolecular Layers", Journal of the American Chemical Society, vol. 60, No. 2, Feb., 1983, pp. 309–319.

E.P. Barrett, et al., "The Determination of Pore Volume and Area Distributions in Porous Substances. I. Computations from Nitrogen Isotherms", The Journal of the American Chemical Society, vo. LXXII, Jan., 1951, pp. 373–380.

S.J. Gregg, et al., "The Physical Adsorption of Gases by Porous Solids", Adsorption, Surface Area and Porosity, Chapter 3, (1967), pp. 121–194.

J. Roček, et al., "Porous Structure of Aluminium Hydroxide and its Content of Pseudoboehmite", Applied Catalysis, vol. 74, (1991), pp. 29–36.

*Primary Examiner*—Pamela R. Schwartz

*Attorney, Agent, or Firm*—Fitzpatrick, Cella, Harper & Scinto

[57] ABSTRACT

A recording medium includes a porous ink-receiving layer whose main components are an alumina hydrate having a boehmite structure, and a binder. The ink-receiving layer contains voids which communicate with the surface of the ink-receiving layer through pores having radii smaller than the radii of the voids. An image forming method forms an image by providing the recording medium with ink droplets.

18 Claims, 2 Drawing Sheets

RECORDING MEDIUM, AND AN IMAGE FORMING METHOD USING THE MEDIUM

BACKGROUND OF THE INVENTION

1. Field of the Invention

This invention relates to a recording medium suitable for recording using aqueous ink, and more particularly, to a recording medium suitable for ink-jet recording which provides high-density images and a clear color tone, which prevents beading, and which has excellent ink-absorbing capability, and to an image forming method using the medium.

2. Description of the Related Art

In an ink-jet recording method, recording of images, characters and the like is performed by discharging very small ink droplets according to various operational principles, and causing the discharged droplets to adhere to a recording medium, such as paper or the like. Since this method has such features as, for example, high-speed and low-noise recording, ease of multicolor recording, great flexibility for patterns to be recorded, and no need for developing and fixing, apparatus for recording various kinds of images using this method have been rapidly popularized for various applications. Furthermore, since images formed according to a multicolor ink-jet method can have quality comparable to the quality of images obtained by multicolor printing according to a plate making method or the quality of printed images according to a color photographing method, and can be obtained at a lower cost than images obtained by ordinary multicolor printing or photographic printing when the number of copies is small, the ink-jet recording method is increasingly applied even to the field of full-color image recording.

In accordance with improvements in recording characteristics, such as an increase in the recording speed, higher definition, capability of full-color recording, and the like, recording apparatus and recording methods have been improved, and higher quality recording media are being demanded.

In order to respond to such demand, various kinds of recording media have been proposed. For example, in Japanese Patent Laid-Open Application (Kokai) No. 52-53012 (1977), ink-jet paper obtained by infiltrating a pigment for surface processing into small-size paper is disclosed. In Japanese Patent Laid-Open Application (Kokai) No. 53-49113 (1978), ink-jet paper obtained by impregnating water-soluble macro-molecules into a sheet incorporating urea-formalin-resin powder is disclosed. In Japanese Patent Laid-Open Application (Kokai) No. 55-5830 (1980), ink-jet recording paper in which an ink-absorbing coated layer is provided on the surface of a supporting sheet is disclosed. In Japanese Patent Laid-Open Application (Kokai) No. 55-51583 (1980), an example of using amorphous silica as a pigment within a coated layer is disclosed. In Japanese Patent Laid-Open Application (Kokai) No. 55-144172 (1980), an image-receiving sheet having a pigment coated layer for adsorbing coloring components of aqueous ink is disclosed. In Japanese Patent Laid-Open Application (Kokai) No. 55-146786 (1980), an example of using a water-soluble macromolecular coated layer is disclosed.

In Japanese Patents Laid-Open Application (Kokai) Nos. 60-61286 (1985), 60-137685 (1985) and 62-174182 (1987), recording media having a porous ink-receiving layer are disclosed. In U.S. Pat. Nos. 4,879,166 and 5,104,730, and Japanese Patents Laid-Open Application (Kokai) Nos. 01-097678 (1989), 2-276670 (1990), 5-024335 (1993) and 6-297831 (1994), recording sheets having an ink-receiving layer using an alumina hydrate having a pseudo-boehmite structure are proposed.

The ideas of the above-described patents relate to improvements in characteristics, such as the ink-absorbing property, resolution, image density, color property, color reproducibility, transparency and the like, of recording media. Along with the achievement of high-speed printing of full-color images as a result of recent progress in recording apparatus, even the above-described improved recording media have the following problems.

1. High-speed full-color printing is performed by superimposing printing of each monocolor ink. It is necessary to absorb ink of a first color and fix the dye of the ink during a short time period of about 100 milliseconds from printing of the first color until printing of the second and subsequent colors. In addition, since printing of a full-color image is performed by superimposing ink of each color, the amount of printed ink per unit area is large.

As conventional techniques, in Japanese Patents Laid-Open Application (Kokai) Nos. 58-110287 (1983), 60-137685 (1985), 60-245588 (1985) and 2-276670 (1990), a recording medium having peaks at 0.2–10 $\mu$m and at 0.05 $\mu$m or less in the pore-radius distribution, a recording medium having very small continuous permeable pores having a volume of 30–300% of the volume of the ink-receiving layer, a recording medium containing an alumina xerogel having pores whose radii are 4.0–100.0 nm, and a recording medium having pores whose radii are 4.0–10.0 nm and whose volume is 0.1–0.4 ml/g are disclosed, respectively. The above-described patents relate to increases in the ink-absorbing speed and the amount of ink absorption amount by adjusting the porous structure, such as the pore-radius distribution, the volume of pores, and the like, of the ink-receiving layer.

In Japanese Patents Laid-Open Application (Kokai) Nos. 05-024335 (1993) and 06-297831 (1994), recording media having an ink-receiving layer, comprising pseudo-boehmite and a binder, in which the ink-absorbing speed and the amount of ink absorption are increased by adjusting the thickness of the ink-receiving layer, the ratio of the pigment to the binder, and the coated amount of the ink-receiving layer, are disclosed.

In the recording media of the first group, although recording media having a porous ink-absorbing layer generally have a relatively high ink-absorbing speed for water-absorbing materials, the radii of pores must be relatively large in order to further increase the ink-absorbing speed. However, since dyes are adsorbed on relatively small pores, if the radii of pores are increased, the fixing speed of dyes decreases, thereby generating beading or blurring, or producing inferior hue in color-mixture portions. Also, in the porous structure having at least two peaks in the pore-radius distribution, if pores having large radii are present, the shapes of dots are not uniform and the roundness of dots is degraded. As the radii of pores increase, haze of the ink-receiving layer increases, thereby providing inferior transparency, and inferior color property and optical density.

In the recording media of the second group, when the thickness or the coated amount of the ink-receiving layer is increased in order to increase the amount of ink absorption, the ink-absorbing speed or the fixing speed of dyes is reduced, and therefore dyes subjected to multicolor printing are mixed before being fixed. If the amount of the binder is reduced, the mechanical strength of the ink-receiving layer is reduced, and cracks and curl are generated.

2. In order to perform full-color printing, the number of gradation steps of each color must be increased and adjusted. In order to increase the number of gradation steps, the optical density of printed portions must be increased. In order to adjust the number of gradation steps, the shape and the uniformity of printed dots must be considered.

As a conventional technique, in Japanese Patent Laid-Open Application (Kokai) No. 55-11829 (1980), a recording medium comprising at least two layers, in which the ink-absorbing property of the uppermost layer is 1.5–5.5 mm/min and the ink-absorbing property of the second layer is 5.5–60.0 mm/min, is disclosed. The idea of this technique is to obtain high resolution by suppressing spread of ink droplets on the surface of the recording medium. However, this technique has the problem that the ink-absorbing speed is very low.

In Japanese Patents Laid-Open Application (Kokai) Nos. 55-144172 (1980), 60-232990 (1985), 62-264988 (1987) and 1-97678 (1989), a recording medium including a receiving layer containing a pigment for adsorbing dyes within ink, a recording medium including an ink-receiving layer containing a cationic aluminum oxide, a recording medium including a material for precipitating dyes within ink) and a recording medium using a material having an adsorbing capability of 20–100 mg/g together with an ink-absorbing agent are disclosed, respectively. The goal of these patents is to increase the fixed amount or the fixing speed of dyes within ink by using a material having a high dye-adsorbing capability, and the water-resistance property of printed portions is improved. However, since the amount of dye adsorption in the ink-receiving layer also depends on the specific surface area and the coated amount of materials constituting the ink-receiving layer, and the ink-absorbing speed and the like must also be considered, the fixed amounts and the fixing speeds of dyes of respective colors required for high-speed multicolor printing cannot be satisfied by only using materials having determined amounts of dye adsorption.

SUMMARY OF THE INVENTION

It is an object of the present invention to solve the above-described problems.

It is another object of the present invention to provide a recording medium in which an excellent image can be obtained even if full-color printing is performed at a high speed, and in which the ink-absorbing speed is high, the amount of ink absorption is large, the fixing speed of the dyes is high, the shapes of the printed dots are uniform, the optical density of printed portions is high, the color property and transparency are excellent, and cracks and curl are minimal, and to provide an image forming method using such a recording medium.

According to one aspect, the present invention which achieves these objectives relates to a recording medium comprising a porous ink-receiving layer whose main components are an alumina hydrate having a boehmite structure, and a binder. The ink-receiving layer contains voids which communicate with the surface of the ink-receiving layer through pores having radii smaller than the radii of the voids.

The foregoing and other objects, advantages and features of the present invention will become more apparent from the following detailed description of the preferred embodiments taken in conjuction with the accompanying drawings.

DETAILED DESCRIPTION OF THE PREFERRED EMBODIMENTS

Figure 1:
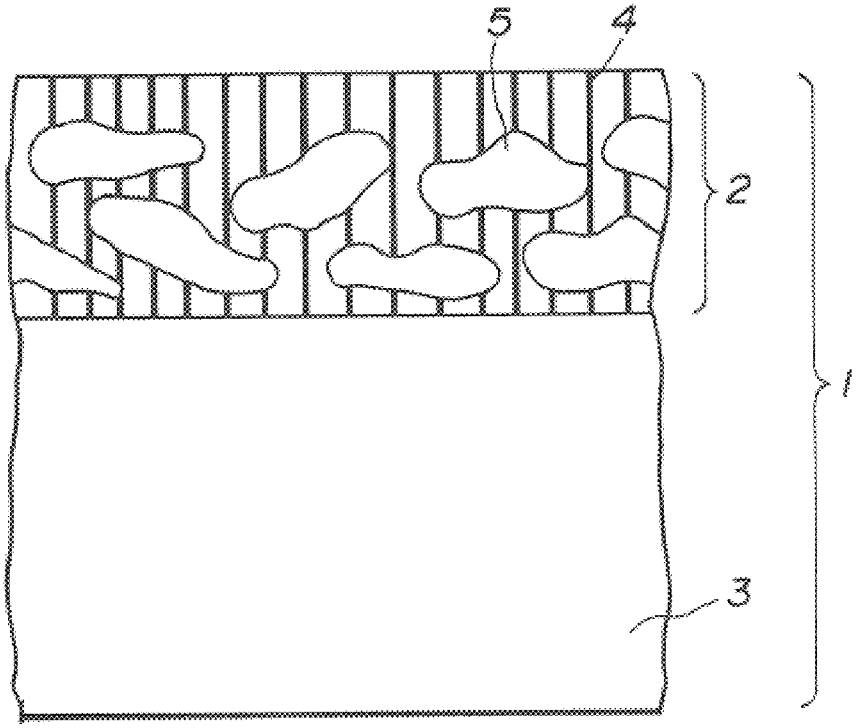
FIG. 1 is a schematic cross-sectional view illustrating the structure of the pores in an ink-receiving layer according to the present invention.

In the present invention, as shown in FIG. 1, a recording medium 1 has the configuration of a porous ink-receiving layer 2 (hereinafter referred to as an "ink-receiving layer"), comprising mainly an alumina hydrate having a boehmite structure, and a binder, and having voids 5 and pores 4, formed on a base material 3. It is possible to also form a protective layer for preventing, for example, damage to the recording medium, or a layer containing particles and the like for improving the conveying property of the recording medium on the ink-receiving layer, when necessary.

Since alumina hydrate has positive electric charges, its fixability of dyes is excellent, an image having excellent color is obtained, and problems, such as browning of black ink, discoloration after exposure to light, and the like, are not present. Hence, this material is preferable as a material used for the ink-receiving layer.

As the alumina hydrate used for the recording medium of the present invention, an alumina hydrate which shows the boehmite structure by X-ray diffraction is preferable because the dye-fixability, the coloring property, the ink-absorbing property and transparency are excellent.

The alumina hydrate is defined by the following general formula:

$$Al_2O_{3-n}(OH)_{2n}.mH_2O,$$

where n represents an integer selected from 0, 1, 2 and 3, and m has a value between 0 and 10, more preferably, between 0 and 5. The expression $mH_2O$ represents, in most cases, a desorbable water phase which does not contribute to the formation of a crystal lattice, and therefore m can also have a value which is not an integer.

In general, the crystal of an alumina hydrate having the boehmite structure is a layer compound whose (020) plane provides a large plane, and provides a peculiar diffraction peak in an X-ray diffraction figure. In addition to the boehmite structure, a structure called a pseudo-boehmite structure which contains extra water between layers of the (020) plane can also be provided. The X-ray diffraction figure of the pseudo-boehmite structure provides a broader diffraction peak than the boehmite structure.

The boehmite structure and the pseudo-boehmite structure cannot be clearly discriminated. Hence, in the present invention, an alumina hydrate having one of the two structures is generally called an alumina hydrate having the boehmite structure (hereinafter referred to as an "alumina hydrate"). The spacing and the crystal thickness of the (020) plane can be determined using Bragg's equation and Scherrer's equation, respectively, from a diffraction angle 2θ of 14–15° where a peak appears and the half-width of the peak. The spacing of the (020) plane can be used as a measure for hydrophilicity and hydrophobicity of an alumina hydrate.

A method for manufacturing the alumina hydrate used in the present invention is not limited to a specific method. For example, any known method, such as hydrolysis of an aluminum alkoxide, hydrolysis of sodium aluminate, or the like, may be used, provided that an aluminum hydrate having the boehmite structure can be made.

As disclosed in Japanese Patent Laid-Open Application (Kokai) No. 56-120508 (1981), the boehmite structure can be obtained by heating an alumina hydrate which is amorphous according to X-ray diffraction at a temperature equal to or higher than 50° C. in the presence of water. A method for obtaining an alumina hydrate by performing hydrolysis/deflocculation by adding an acid to a long-chain aluminum alkoxide is particularly preferable.

The long-chain aluminum alkoxide is, for example, an alkoxide having five or more carbon atoms. The use of an alkoxide having 12–22 carbon atoms is preferable because, as will be described later, removal of alcohol components and the control of the shape of the alumina hydrate can be more easily performed.

At least one kind of acid can be freely selected from among organic acids and inorganic acids and can be used as the acid to be added. However, nitric acid is most preferable from the viewpoint of the reaction efficiency of hydrolysis and the control of the shape, and the dispersibility of the obtained alumina hydrate. It is also possible to control the particle size by performing hydrothermal synthesis or the like after this process. If hydrothermal synthesis is performed using an alumina-hydrate dispersion liquid including nitric acid, the nitric acid within the aqueous solution is taken up on the surface of the alumina hydrate as nitric-acid radicals, thereby improving water dispersibility.

The above-described method of hydrolysis of an aluminum alkoxide has the advantage that impurities, such as various kinds of ions and the like, are not easily mixed in, compared with a method of manufacturing an alumina hydrogel or cationic alumina. Another advantage is that in a long-chain aluminum alkoxide, a long-chain alcohol after hydrolysis can perform dealcoholation of an alumina hydrate more perfectly compared with, for example, a short-chain alkoxide, such as aluminum isoproxide or the like. It is preferable to set the pH of the solution when starting hydrolysis to a value equal to or less than 6. A pH value equal to or more than 8 is not preferable because the obtained alumina hydrate becomes crystalline.

An alumina hydrate containing a metal oxide, such as titanium dioxide or the like, can also be used as the alumina hydrate for the present invention, provided that the boehmite structure can be confirmed by, for example, X-ray diffraction. A percentage content between 0.01 and 1.00 weight % of the alumina hydrate is preferable because high optical density is obtained. A percentage content between 0.13 and 1.00 weight % is more preferable because the dye-adsorbing speed is increased, thereby preventing occurrence of blurring and beading. The valency of titanium in the above-described titanium dioxide must be +4. The content of titanium dioxide can be measured according to the ICP method by fusing it in boric acid. The distribution of the titanium dioxide within the alumina hydrate and the valency of titanium can be analyzed using ESCA (electron spectroscopy for chemical analysis).

A change in the content of titanium can be checked by etching the surface of the alumina hydrate with argon ions for 100 seconds and 500 seconds. If the valency of titanium is less than +4, titanium dioxide functions as a catalyst, thereby degrading the binder and easily producing cracks and loose powder.

The titanium dioxide may be contained only in the vicinity of the surface of the alumina hydrate, or may be contained within the alumina hydrate. The content of the titanium dioxide may change from the surface to the inside. It is preferable to contain the titanium dioxide only in the proximity of the surface of the alumina hydrate, because the characteristics of the bulk of the alumina hydrate are easily maintained.

It is preferable to manufacture an alumina hydrate containing titanium dioxide according to a manufacturing method of performing hydrolysis of a mixed solution of an aluminum alkoxide and a titanium alkoxide, as described, for example, in "Hyomen no Kagaku (Science of Surfaces)", p. 327, edited by Kenji Tamaru and published by Gakkai Shuppan Center (1985) (in Japanese). Another manufacturing method, in which an alumina hydrate is added as seed for crystal growth when performing hydrolysis of the above-described mixed solution of the aluminum alkoxide and the titanium alkoxide, may also be adopted.

Instead of titanium dioxide, an oxide of magnesium, calcium, strontium, barium, zinc, boron, silicon, germanium, tin, lead, zirconium, indium, phosphorous, vanadium, niobium, tantalum, chromium, molybdenum, tungsten, manganese, iron, cobalt, nickel, ruthenium or the like may also be included. Titanium dioxide is most preferable from the viewpoint of adsorbability of dyes and dispersibility. While many of the above-described metal oxides have colors, titanium dioxide is colorless and is therefore preferable.

The shape of the alumina hydrate can be observed under a transparent electron microscope after preparing a sample for measurement by dispersing the alumina hydrate in water, alcohol or the like and dripping the obtained solution onto a corodion film. As described in "Rocek J. et al., Applied Catalysis, vol. 74, pp. 29–36, 1991", it is generally known that an alumina hydrate having the pseudo-boehmite structure has a needle-like shape or other shapes.

In the present invention, an alumina hydrate having a needle-like shape or a flat plate-like shape can be used. The shape of an alumina hydrate (the shape, the size and the aspect ratio of particles) can be measured by preparing a sample for measurement by dispersing the alumina hydrate in ion-exchanged water and dripping the obtained solution onto a corodion film, and observing the sample under a transmission electron microscope.

According to the knowledge of the inventors of the present invention, flat plate-shaped alumina hydrates have better dispersibility in water than needle-shaped or hair-bundle-shaped alumina hydrates. It is preferable to form an ink-receiving layer using a flat plate-shaped alumina hydrate, because orientation of the particles of the alumina hydrate is randomized, thereby providing a large pore volume and a wide pore-radius distribution. The hair-bundle-like shape indicates a state in which needle-shaped alumina hydrate particles agglomerate in the shape of a hair bundle with their sides in contact with one another. The aspect ratio of flat plate-shaped particles can be obtained according to the method defined in Japanese Patent Publication No. 5-16015 (1993). The aspect ratio represents the ratio of the diameter to the thickness of particles.

The diameter means the diameter of a circle having the same area as the projected area of the particle when the alumina hydrate is observed under a microscope or an electron microscope. The vertical/horizontal ratio represents the ratio of the minimum value to the maximum value of the diameters of the flat plate-shaped particles when the particles of the alumina hydrate are observed in the same manner as for the aspect ratio. In the case of hair-bundle-shaped particles, the aspect ratio can be obtained by determining the ratio of the diameter of the cross section to the length.

The most preferable shape of an alumina hydrate is represented by an average aspect ratio within the range of 3–10 and an average particle diameter within the range of 1.0–50 nm for a flat plate-shaped alumina hydrate, and by an average aspect ratio within the range of 3–10 and an average particle length within the range of 1.0–50 nm for a hair-bundle-shaped alumina hydrate. If the average particle diameter or the average particle length is within the above-described range, scattering of light can be prevented. Hence, excellent transparency can be provided for the ink-receiving layer. If the average aspect ratio is within the above-described range, voids are formed between particles when forming an ink-receiving layer. Hence, a porous structure can be easily formed.

If the average particle diameter or the average particle length is smaller than the lower limit of the above-described range, the pore-size distribution is narrowed, thereby decreasing the ink-absorbing speed. If the average particle diameter or the average particle length is greater than the upper limit of the above-described range, haze tends to be generated in the ink-receiving layer, thereby degrading transparency. If the average aspect ratio is smaller than the lower limit of the above-described range, the range of the pore-radius distribution of the ink-receiving layer is narrowed, thereby reducing the ink-absorbing speed. If the average aspect ratio is greater than the upper limit of the above-described range, it is difficult to manufacture the alumina hydrate while making the size of the particles of the alumina hydrate uniform.

The recording medium of the present invention can be obtained by forming a porous ink-receiving layer mainly using an alumina hydrate and a binder. The characteristics of the recording medium can be changed by changing the kind and the quantity ratio of the alumina hydrate and the binder to be used, the kinds and the amounts of additives, conditions of dispersion of a coating liquid in which the alumina hydrate is dispersed, and heating conditions when drying the recording medium.

The ink-receiving layer in the present invention contains voids, which communicate with the surface of the ink-receiving layer through pores having radii smaller than the radii of the voids. Preferably, the voids communicate with one another via the pores within the ink-receiving layer.

The maximum peak in the pore-radius distribution of the ink-receiving layer is preferably within the range of 2.0–20.0 nm. If the peak is within this range, generation of blurring and bleeding can be prevented by increasing both the ink-absorbing speed and the fixing speed of dyes. If the position of the peak exceeds the upper limit of the above-described range, the fixing speed of dyes decreases, thereby tending to generate blurring or to reduce roundness of the printed dots. If the position of the peak is under the lower limit of the range, the ink-absorbing speed tends to decrease.

Blurring is the phenomenon in which, when solid printing is performed on a certain area, the area of a portion colored by a dye becomes larger than the printed area. Bleeding is the phenomenon in which blurring is generated at each border between different colors of a portion where solid multicolor printing is performed and dyes are mixed without being fixed.

The volume of pores in the ink-receiving layer is preferably within the range of 0.4–1.0 ml/g. The amount of ink absorption and the ink-absorbing speed are favorable within this range. The volume of pores is more preferably within the range of 0.4–0.6 ml/g, because haze in the ink-receiving layer is reduced, thereby improving transparency and increasing the mechanical strength, which prevents cracking.

If the volume of pores exceeds the upper limit of the above-described range, cracks, peeling, and loose powder tend to occur, and haze tends to be generated to degrade transparency. If the volume of pores is less than the lower limit of the above-described range, the amount of ink absorption is insufficient, thereby tending to generate overflow of ink, and the ink-absorbing speed is insufficient, thereby tending to degrade the fixability of ink at the printed portions. The volume of pores per unit area in the ink-receiving layer is preferably at least 8 ml/$M^2$. Overflow of ink does not occur within this range even if high-speed printing is performed. The volume of pores per unit area in the ink-receiving layer is more preferably at least 20 ml/$m^2$. Overflow of ink does not occur within this range even if multicolor printing is performed.

If the volume of pores per unit area is less than the lower limit of the above-described range, ink overflows from the ink-receiving layer when performing multicolor printing, thereby tending to generate blurring of the image. The method for adjusting the volume of pores can be selected from among general methods for adjusting the volume of pores of a porous material, such as control of aging conditions of the alumina hydrate, control of dispersion and drying conditions of the coating liquid, and the like.

Various methods described in, for example, Japanese Patent Laid-Open Application (Kokai) No. 56-120508 (1981) can be used for increasing the volume of pores. The volume of pores per unit area can be made to be within the above-described range by adjusting the alumina hydrate, the coating liquid, coating/drying conditions, the thickness of the ink-receiving layer, and the like.

The ratio of the volume of pores having radii within the range of 2.0–20.0 nm to the total volume of pores in the ink-receiving layer is preferably at least 80%. The transparency and smoothness of the surface of the ink-receiving layer can be improved if the ratio is within the above-described range. If the ratio is less than the above-described range, the transparency of the ink-receiving layer is degraded and its mechanical strength is reduced, thereby tending to crack and create loose podwer.

The pore-radius distribution and the volume of pores of the ink-receiving layer described above can be obtained according to a nitrogen adsorption/desorption method. The BET specific surface area and the isothermal nitrogen adsorption/desorption curve can also be obtained according to the above-described method.

Figure 2:
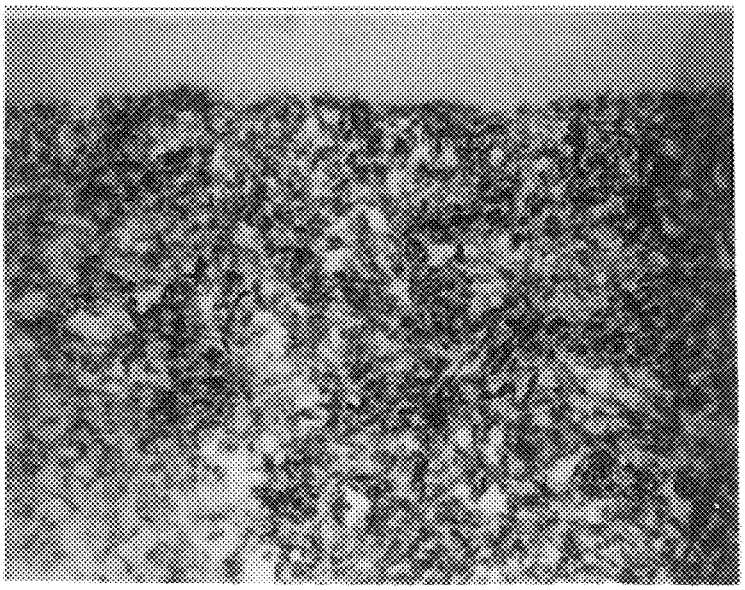
FIG. 2 is a photograph illustrating the structure of particles in a cross section of an ink-receiving layer according to a first embodiment of the present invention.
Figure 3:
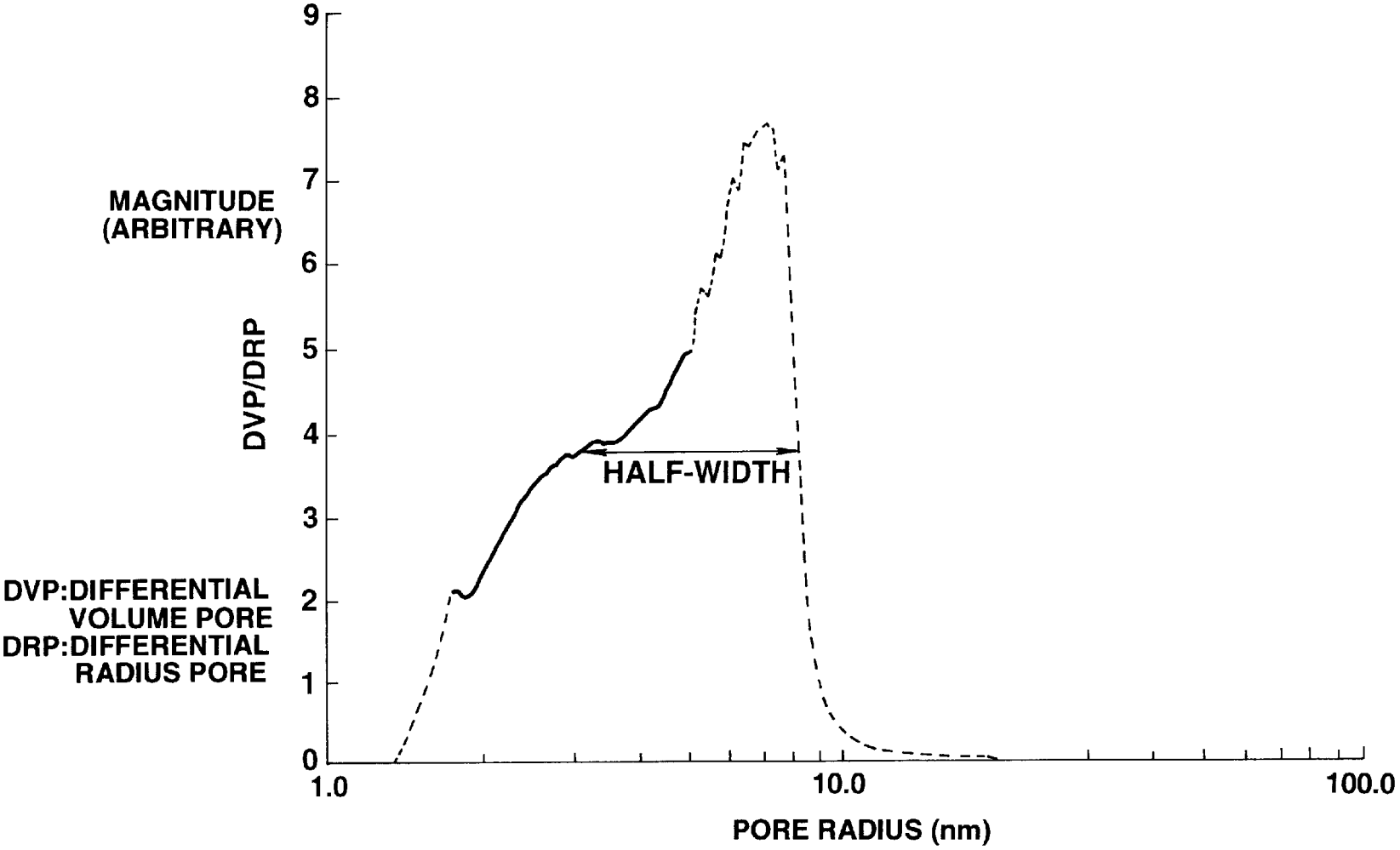
FIG. 3 is a graph illustrating the pore-radius distribution of the ink-receiving layer of the first embodiment according to a nitrogen adsorption/desorption method.

As can be seen in the cross-sectional view of the ink-receiving layer shown in FIG. 1 and the photographic cross section of the ink-receiving layer shown in FIG. 2, voids in the ink-receiving layer in the present invention are present only within the ink-receiving layer, and as shown in pore radius distribution of FIG. 3, cannot be measured by usual methods for measuring a pore structure, such as the nitrogen adsorption/desorption method, the method of mercury penetration porosimetry, X-ray small-angle scattering, a laser microscope and the like. The radii and the volume ratio of voids can be obtained by observing the cross section of the ink-receiving layer using an electron microscope or the like and measuring them on the obtained photograph.

The role of voids within the ink-receiving layer in the present invention is to diffuse ink in lateral directions (within the surface) of the ink-receiving layer through pores communicating with the surface of the ink-receiving layer. A decrease in the ink-absorbing speed due to storage of ink within pores is thereby prevented, and the ink-absorbing speed for second and subsequent colors when performing superimposed printing at a short time interval of about 100 msec is thereby increased.

The radii of voids within the ink-receiving layer must be larger than the radii of pores, and are preferably equal to or larger than 1.5 times the above-described peak radius of pores. The above-described roles of diffusion and the like can be sufficiently achieved if the radii of voids are within the above-described range, and overflow of ink can be prevented by quickly absorbing ink even if high-speed printing with a large amount of ink per unit area is performed by a recent-model high-speed full-color printer. The radii of voids are most preferably within the range of 50.0–200.0 nm. Whitening and generation of cracks in the ink-absorbing layer are prevented if the radii of voids are within this range. If the radii of voids exceed 200 nm, the ink-receiving layer tends to whiten, thereby degrading its transparency and it cracks readily due to insufficient mechanical strength.

If the radii of voids are less than 1.5 times the peak radius of pores, the benefits they provide, such as diffusion and the like, are decreased, thereby tending to cause an insufficient increase in the ink-absorbing speed of the pores, to reduce the ink-absorbing speed, and to generate overflow of ink during printing of second and subsequent colors when performing multicolor printing. The volume of voids is preferably 1–10% of the volume of the ink-receiving layer. Very few cracks are generated in the ink-receiving layer even if the recording medium is bent, and very little deformation occurs on printed portions if the volume of voids is within this range.

In the present invention, the amount of water absorption of the ink-receiving layer is preferably within the range of 0.4–1.0 ml/g. If the amount of water absorption is within this range, overflow of ink when performing superimposed printing repeatedly using a large amount of ink as in the case of multicolor printing can be prevented. The amount of water absorption is more preferably within the range of 0.6–0.9 ml/g. If the amount of water absorption is within this range, generation of cracks and deformation of the ink-receiving layer before and after printing can be prevented. If the amount of water absorption exceeds the upper limit of the above-described range, the mechanical strength of the ink-receiving layer is insufficient, thereby tending to generate cracks, peeling, and loose powder, and to decrease transparency. If the amount of water absorption is less than the lower limit of the above-described range, the ink-absorbing speed during printing of second and subsequent colors tends to decrease when performing multicolor printing, and the diameter of dots during printing of second and subsequent colors tends to increase, thereby degrading uniformity of hue at color-mixture portions.

The amount of water absorption of the ink-receiving layer is preferably within the range of 10–50 g/m$^2$. If the amount of water absorption is within this range, generation of beading and blurring can be prevented even if printing providing a large amount of ink per unit time, such as high-speed full-color printing, is performed. If the amount of water absorption is within the range of 15–40 g/m$^2$, the range of amounts of ink to be printed is increased, and the diameter of dots is constant regardless of the amount of printing. If the amount of water absorption exceeds the upper limit of the above-described range, the diameter of dots decreases when the amount of ink to be printed is small, thereby tending to generate non-colored portions to provide a stipple-like unnatural image. If the amount of water absorption is less than the lower limit of the above-described range, overflow of ink and beading tend to occur when full-color printing is performed at a high speed.

The amount of water absorption can be measured according to the following method. A recording medium having an ink-receiving layer formed thereon is cut into a square having sides of 100 mm. Ion-exchanged water is dripped little by little onto a central portion of the square, and is absorbed therein by uniformly spreading the water with a spatula at each drip. This operation is repeated until the ion-exchanged water overflows. The ion-exchanged water remaining on the surface of the sample is wiped using a cloth or the like. The amount of water absorption is obtained from the difference in the weight of the recording medium before and after the absorption of the ion-exchanged water.

In the present invention, the in-plane diffusion coefficient of the ink-receiving layer is preferably within the range of 0.7–1.0. If the in-plane diffusion coefficient is within this range, the ink-absorbing speed does not decrease even if superimposed printing of at least two to four colors is performed at a short time interval of about 100 msec.

The in-plane diffusion coefficient of the ink-receiving layer indicates the ease of diffusion of printed ink within the plane of the ink-receiving layer, and can be obtained from the amount of water absorption of the recording medium and the amount of absorption at one point of the recording medium in the following manner. As in the case of the measurement of water absorption, a recording medium having an ink-receiving layer formed thereon is cut into a square having sides of 100 mm, and ion-exchanged water is dripped onto a central point little by little and is absorbed therein. At that time, it is necessary to prevent the dripped ion-exchanged water from spreading on the surface of the ink-receiving layer before being absorbed at the dripped point. As in the case of measurement of water absorption, this operation is repeated until the ion-exchanged water overflows. The amount of absorption at the one point of the recording medium is obtained from the difference in the weight of the recording medium before and after the absorption of the ion-exchanged water.

The in-plane diffusion coefficient is calculated as the ratio of the amount of absorption at the one point of the recording medium to the amount of water absorption of the recording medium.

The BET specific surface area of the ink-receiving layer of the present invention is preferably within the range of 70–300 m$^2$/g, and the ink-receiving layer preferably contains an alumina-hydrate having an average particle diameter or an average particle length of 1.0–50 nm. If plate-like fine particles having an average diameter of 1.0–50 nm or needle-like fine particles having an average length of 1.0–50 nm are used, and the specific surface area of the ink-receiving layer is within the range of 70–300 m$^2$/g, scattering of light is small, thereby providing excellent transparency of the ink-receiving layer. By using the above-described fine alumina hydrate, the fixing speed and the amount of dyes fixed onto the alumina hydrate can be increased.

If the BET specific surface area is smaller than the lower limit of the above-described range, the ink-receiving layer tends to whiten, and the water-resistance property of dyes becomes, in some cases, insufficient because adsorption points for dyes are insufficient. If the BET specific surface area is greater than the upper limit of the above-described range, cracks tend to be generated in the ink-receiving layer.

Preferably, the distribution of the radii of the pores has its largest peak within the range of 2.0 to 20.0 nm. Pores in the ink-receiving layer of the present invention may have one of the following pore structures A and B or may have both of the pore structures A and B as need be.

In the pore structure A, it is preferable that the average pore radius of the ink-receiving layer is within the range of 2.0–20.0 nm and the half-width of the pore-radius distribution is within the range of 2.0–15.0 nm. As described in Japanese Patents Laid-Open Application (Kokai) Nos. 4-267180 (1992) and 5-16517 (1993), a dye of an ink is selectively absorbed/fixed on pores having a specific radius. However, for the average pore radius and the half-width within the above-described ranges, the range of selection of dye increases, and the dye adsorption capability and the dye-adsorbing-speed index do not depend on the kind of the dye within the ink. More preferably, the half-width is within the range of 4.0–10.0 nm. If the half-width is within this range, the range of selection for the fixing speed of the dye can be increased. As described in Japanese Patents Laid-Open Application (Kokai) Nos. 51-38298 (1976) and 4-202011 (1992), the average pore radius can be obtained from the volume of pores and the BET specific surface area. The half-width of the pore radius distribution indicates the width of the radii of pores having a frequency half the frequency of the average pore radius. If the average pore radius is greater than the upper limit of the above-described range, adsorption and fixing of the dye within the ink are degraded, thereby tending to generate blurring in the obtained image. If the average pore radius is smaller than the lower limit of the above-described range, absorption of ink is degraded, thereby tending to generate bleeding. If the half-width is greater than the upper limit of the above-described range, absorption of solvent components within the ink decreases, thereby tending to generate blurring. If the half-width is smaller than the lower limit of the above-described range, the range of selection of ink decreases, and the fixing speed and the amount of the dye fixed and the dot size, in some cases, differ upon printing using different kinds of ink having different dyes and material compositions. As disclosed, for example, in Japanese Patent Laid-Open Application (Kokai) No. 6-114671 (1994), the pore-radius distribution of the ink-receiving layer can be widened by providing nonuniform particle radii of the alumina hydrate being used.

The pore structure B has at least two peaks in the pore-radius distribution of the ink-receiving layer. In this pore distribution, the functions of pores are separated. That is, relatively large pores absorb the solvent component within the ink more quickly, and relatively small pores adsorb and fix the dye within the ink more quickly. As a result, an ink-receiving layer in which both absorption of the ink and fixing of the dye are excellent can be obtained. Preferably, one of the peaks is present at a pore radius of 10.0 nm or less, and more preferably, at a pore radius within the range of 1.0–6.0 nm. It is preferable that another peak be present at a pore radius within the range of 10.0–20.0 nm.

In the present invention, regarding the ratio of solvent to dye in the ink, the peak at the pore radius within the range of 10.0–20.0 nm is greater than the peak at the pore radius equal to or less than 10.0 nm. The volume of pores having radii equal to or less than 10.0 nm is preferably within the range of 0.1–10% of the total volume of pores from the viewpoint of the fixing speed of dyes, and more preferably, within the range of 1–5%. If the volume of pores having pore radii equal to or less than 10.0 nm is within this range, both the ink-absorbing speed and the dye-absorbing speed are excellent.

The method for providing at least two peaks in the pore-radius distribution of the ink-receiving layer can be, for example, a method of increasing the time period of hydrothermal synthesis of the alumina hydrate to be used, or a method of using alumina having an anisotropic shape, as disclosed in Japanese Patent Laid-Open Application (Kokai) No. 6-114669 (1994).

In the recording medium of the present invention, the absorption time period when performing printing of 16×16 dots per $mm^2$ by dripping 30 ng of ink at one point on the ink-receiving layer is preferably within the range less than or equal to 400 msec. If the absorption time period is within the above-described range, overflow and blurring due to insufficient ink-absorbing speed when performing high-speed printing can be prevented. If the absorption time period exceeds the upper limit of the above-described range, overflow and beading of ink tend to occur when increasing the printing speed. In the recording medium of the present invention, the absorption time period when printing at 16×16 dots per $mm^2$ is performed twice at an interval of 100 msec with 30 ng of ink on the ink-receiving layer is preferably within the range less than or equal to 600 msec. In addition, the absorption time period when consecutively performing the above-described printing operation three times is preferably within the range less than or equal to 1200 msec. If the absorption time period is within the above-described ranges, overflow of ink does not occur even if high-density printing is performed, and a decrease in the absorption speed for subsequently printed ink influenced by previously printed ink does not occur. If the absorption time period exceeds the upper limits of the above-described ranges, overflow and beading of ink, in some cases, occur when performing high-speed printing or multicolor printing. The above-described ink-absorbing time periods can be achieved by providing internal voids, and pores communicating with them, in the ink-receiving layer of the recording medium.

The spacing of the (020) plane of the alumina hydrate in the recording medium of the present invention is preferably within the range exceeding 0.617 nm and less than or equal to 0.620 nm. If the spacing is within this range, the range of selection of ink dyes and materials can increase. When printing is performed using at least one of a hydrophobic dye and a hydrophilic dye, occurrence of blurring and cissing (portions not colored by dye in portions subjected to solid printing) is decreased, and the optical density and the size of dots of each dye become uniform.

This is because of the following reasons. That is, if the spacing of the (020) plane is within the above-described range, the quantitative ratio of hydrophobicity to hydrophilicity of the alumina hydrate in the recording medium is within an appropriate range. Hence, fixing of each dye and absorption of the solvent are excellent, and the binding force with the binder resin is increased, thereby preventing generation of cracks. In addition, since the amount of water contained between layers of the alumina hydrate is constant and not excessive, the amount of curl is small.

If the spacing of the (020) plane is less than the lower limit of the above-described range, discoloration over time tends to occur because catalytic ative sites increase. In addition, the hydrophobicity of the surface of the alumina hydrate is strengthened, and therefore wettability for ink becomes insufficient, thereby producing cissing. On the other hand, in the case of a hydrophilic dye, blurring and beading tend to occur, and cracks and loose powder formation tend to occur because the binding force with the binder resin is weakened.

If the spacing of the (020) plane exceeds the upper limit of the above-described range, the amount of water contained between layers of the alumina hydrate increases, thereby tending to generate curl and cracks in the recording medium. In addition, since the coefficient of water absorption is large, curl and tack tend to occur depending on environmental conditions, and the amount of ink absorption and the ink-absorbing time period tend to change. Moreover, since the surface of the alumina hydrate becomes hydrophilic, if a dye having strong hydrophobicity is used, blurring and beading tend to occur, and the water-resistive property of the dye tends to be degraded.

The method for adjusting the spacing of the (020) plane within the above-described range can be selected, for example, from among a method of preparing a dispersion liquid using the powder of an alumina hydrate powder having a spacing of the (020) plane within the range exceeding 0.617 nm and less than or equal to 0.620 nm, and drying the liquid at a temperature less than or equal to the transition temperature of the alumina hydrate to provide an ink-receiving layer, a method of drying a dispersion liquid of an alumina hydrate at a temperature for providing the spacing of the (020) plane within the range exceeding 0.617 nm and less than or equal to 0.620 nm to provide an ink-receiving layer, and a method of mixing an alumina hydrate having a spacing of the (020) plane less than or equal to 0.617 nm and an alumina hydrate having a spacing of the (020) plane equal to or more than 0.620 nm, as the situation demands.

The crystal thickness (size) of the (020) plane of the alumina hydrate in the recording medium of the present invention is preferably within the range of 6.0 nm–10.0 nm. If the crystal thickness is within this range, the transparency, the absorbing property, the dye-adsorbing property and the fixability are excellent, and very few cracks are generated. If the crystal thickness is less than the lower limit of the aboved-described range, the dye-adsorbing property and the fixability are degraded, and the optical density of printed portions tend to decrease. In addition, the binding force of the binder is weakened, thereby tending to generate cracks. If the crystal thickness exceeds the upper limit of the above-described range, haze is generated, which degrades transparency, thereby tending to decrease the optical density of the printed portions. According to the knowledge of the inventors of the present invention, since there is a correlation between the spacing of the (020) plane and the crystal thickness of the (020) plane, if the spacing of the (020) plane is within the above-described range, the crystal thickness of the (020) plane can be adjusted to the range of 6.0–10.0 nm.

The pore structure and the like of the ink-receiving layer are not determined only by the kind of the alumina hydrate to be used, but change depending on various manufacturing conditions, such as the kind and the mixture proportions of the binder, the density, the viscosity and the state of dispersion of the coating liquid, the coating apparatus, the coating head, the coated amount, the amount, the temperature and the direction of the drying air current, and the like. Hence, in order to obtain the characteristics of the ink-receiving layer claimed in the present invention, it is necessary to control the manufacturing conditions to be within an optimum range.

In the present invention, other additives than the alumina hydrate can also be added. The additives can be freely selected from among various kinds of metal oxides, metal salts having a valency equal to or more than 2, and cationic organic substances, if necessary.

As metal oxides, oxides, such as silica, silica-alumina, boria, silica-boria, magnesia, silica-magnesia, titania, zirconia, zinc oxide and the like are preferable. As metal salts having a valency equal to or more than 2, salts, such as calcium carbonate, barium sulfate and the like, halide salts, such as magnesium chloride, calcium bromide, calcium nitrate, calcium iodide, zinc chloride, zinc bromide, zinc iodide and the like, kaolin, talc and the like are preferable. As cationic organic substances, quarternary ammonium salts, polyamine, alkylamine, and the like are preferable. The added amount of additives is preferably equal to or less than 20 weight % of the pigment.

As the binders used in the present invention, at least one kind of water-soluble polymers can be freely selected. For example, polyvinyl alcohol or modified substances thereof, starch or modified substances thereof, gelatin or modified substances thereof, casein or modified substances thereof, gum arabic, cellulose derivatives, such as carboxymethyl cellulose and the like, conjugate diene-type copolymer cellulose latexes, such as SBR (styrene-butadiene rubber) latex and the like, vinyl-type copolymer latexes, such as functional-group-modified polymer latex, ethylenevinyl acetate copolymer and the like, polyvinyl pyrrolidone, maleic anhydride or copolymers thereof, acrylic ester copolymers, and the like are preferable.

The mixing ratio of the alumina hydrate and the binder can be arbitrarily selected from the range of 5:1–20:1 by weight. If the amount of the binder is less than the lower limit of the above-described range, the mechanical strength of the ink-receiving layer becomes insufficient, thereby tending to produce cracks and loose powder. If the amount of the binder exceeds the upper limit of the above-described range, the pore volume decreases, thereby degrading the ink-absorbing property.

It is also possible to add at least one of a pigment-dispersing agent, a thickener, a pH-adjusting agent, a lubricant, a fluidity-modifying agent, a surface active agent, an antifoaming agent, a hydration-resistive agent, a foam inhibitor, a mold releasing agent, a foaming agent, a penetrant, a coloring dye, a fluorescent whitening agent, an ultraviolet-ray absorbing agent, an antiseptic, a preservative and the like to the alumina hydrate and the binder, if necessary. As the hydration-resistive agent, any material freely selected from among known materials, such as halogenated quarternary ammonium salts, quarternary ammonium salt polymers and the like can be used.

In the present invention, as the base material used for forming the ink-receiving layer, any sheet-like substance, such as various kinds of paper, for example, paper subjected to appropriate sizing, unsized paper, resin-coated paper using polyethylene or the like, a thermoplastic film, or the like, can be used without any particular limitation. As the thermoplastic film, a transparent film made of polyester, polystyrene, polyvinyl chloride, polymethyl methacrylate, cellulose acetate, polyethylene, polycarbonate or the like, or a sheet which is made to be opaque by filling of a pigment or fine foams can be used.

The recording medium of the present invention can be formed by adding a binder to a dispersion liquid including an alumina hydrate, coating the resultant liquid on a base material, and drying the coated base material to form an ink-receiving layer.

It is also possible to perform post-production drying, cutting, packing, inspection and the like, if necessary.

In the present invention, there is no particular limitation on the method for forming an ink-receiving layer having internal voids, and pores connected to the surface of the ink-receiving layer while communicating with the voids, but at least one of the following four kinds of methods can be selectively used.

(1) A method for forming an ink-receiving layer by coating a dispersion liquid including an alumina hydrate and a binder on a base material, then drying portions close to the surface earlier by controlling drying conditions to form a voidless film near the surface, and drying a solvent component remaining within the film.

(2) A method for obtaining an ink-receiving layer by forming a coagulation of an alumina hydrate, adding a material for increasing the surface tension of a dispersion liquid including the coagulation, or a material for increasing the film-forming force to the dispersion liquid, and coating the resultant liquid on a base material and drying the obtained film.

(3) A method of adding a solvent having a higher boiling point than that of a dispersion medium of a dispersion liquid of an alumina hydrate to the dispersion liquid, coating the resultant liquid on a base material, drying portions close to the surface of the obtained film at a temperature lower than or equal to the boiling point of the high-boiling-point solvent to form a dense film, and then gradually drying the solvent remaining within the film. Alternatively, a method of adding a material for increasing the surface tension of the dispersion liquid or a material for increasing the film-forming force to the dispersion liquid, coating the resultant liquid, and drying the obtained film.

(4) A method of coating a dispersion liquid including a coagulation of an alumina hydrate and a binder on a base material, coating another dispersion liquid including fine particles of the alumina hydrate which do not agglomerate and a binder on a base material, and drying the obtained film.

The coagulation of the alumina hydrate can be formed, for example, by adding an electrolyte, comprising anions, cations, salts and the like, to a water dispersion liquid including the alumina hydrate in such an amount that a thixotropic property does not appear; by preparing a large xerogel of at least the secondary order by effecting self-agglomeration of the alumina hydrate, performing wet or dry grinding processing of the xerogel, and performing, when necessary, a classification processing; by agglomerating the alumina hydrate by adding a share to a water dispersion liquid including the alumina hydrate; by forming a xerogel having coupling among primary particles by drying a water dispersion liquid including the alumina hydrate; by adding a dispersant, such as an acid or the like, to a hydrogel of the alumina hydrate, and then performing dispersion processing of the resultant gel until a predetermined particle size is obtained; or by adding organic substances and the like to the alumina hydrate, and performing granulation according to graft polymerization or the like. When using a coagulation of the alumina hydrate, in order to make the size of voids within the range provided in the present invention, the diameter of particles of the coagulation is preferably within the range of 0.1–50 $\mu$m.

As the material for increasing the surface tension of a dispersion liquid or the material having a high film-forming force, for example, melamine-type materials, aldehyde-type materials, materials which can perform cross-linking of a binder, such as boric acid, borates and the like (cross-linking agents), resins having relatively high molecular weights, such as polyvinyl alcohol resins having a degree of polymerization of at least 2000, acryl-type resins and the like, are preferably used.

As the solvent having a higher boiling point than that of the dispersion medium of the dispersion liquid, for example, solvents having boiling points equal to or higher than 100° C. and equal to or lower than 180° C., such as DMF, ethylene glycol, propylene glycol, and esters thereof, are preferably used.

The method for dispersing the dispersion liquid including the alumina hydrate can be selectively used from among methods which are generally used for dispersion. As the apparatus for that purpose, an apparatus which performs gentle stirring, such as a homomixer, rotating blades or the like, is preferable to a grinding dispersion machine, such as a ball mill, a sand mill or the like. The shear stress is preferably within the range of 0.1–100.0 N/m$^2$, though it depends on the viscosity, the amount and the volume of the dispersion liquid. If a strong shearing stress which exceeds the above-described range is applied, the dispersion liquid is gelatinized, or the crystal structure is transformed into an amorphous state. The shearing stress within the range of 0.1–20.0 N/m$^2$ is more preferable, because destruction of the pore structure and a decrease in the volume of pores can be prevented.

Although the dispersion time period varies depending on the amount of the dispersion liquid, the size of the receptacle, the temperature of the dispersion liquid, and the like, a dispersion time period equal to or less than 30 hours is preferable from the viewpoint of preventing a change in the crystal structure. If the dispersion time period is equal to or less than 10 hours, the pore structure can be controlled within the above-described range. During dispersion processing, the temperature of the dispersion liquid may be maintained within a certain range by performing cooling, heat insulation or the like. The preferable temperature range is 10–100° C., though it depends on the method of dispersion processing, the material and the viscosity. If the temperature is lower than the lower limit of the above-described range, dispersion processing is insufficient, or agglomeration occurs. If the temperature is higher than the upper limit of the above-described range, the dispersion liquid is gelatinized, or the crystal structure is transformed into an amorphous state.

In the present invention, coating of the dispersion liquid of the alumina hydrate when forming the ink-receiving layer can he performed using a generally used apparatus, such as a blade coater, an air-knife coater, a roll coater, a brush coater, a curtain coater, a bar coater, a gravure coater, a sprayer or the like. The coated amount of the dispersion liquid is preferably within the range of 0.5–60 g/m$^2$ converted to the amount of the dried solid component. If the coated amount is within this range, the amount of ink absorption and the ink-absorbing speed can be satisfied. In addition, the fixing speed and the fixed amount of the printed dye can be satisfied, blurring in printing portions is small, and the water-resistant property is excellent.

More preferably, the coated amount is within the range of 5–45 g/m$^2$ converted to the amount of a dried solid component. If the coated amount is within this range, cracks and curl can be prevented. If the coated amount exceeds the upper limit of the above-described range, cracks tend to be produced, and the ink-absorbing speed is reduced. If the coated amount is less than the lower limit of the above-described range, the amount of ink absorption is insufficient, and the dye-adsorbing-speed index is reduced. It is also possible to improve the smoothness of the surface of the ink-receiving layer using a calender roller or the like after coating when necessary.

The ink used in the image forming method of the present invention mainly includes a coloring agent (a dye or a pigment), a water-soluble organic solvent and water. As the dye, water-soluble dyes, represented by direct dyes, acid dyes, basic dyes, reactive dyes, food colors and the like, are preferable. Any dye which provides an image satisfying the required properties, such as fixability, coloring property, color clearness, stability, light stability and the like, by being combined with the above-described recording medium may be used.

The water-soluble dye is generally used by being dissolved in water or a solvent comprising water and an organic solvent. As the solvent, a mixture of water and various kinds of water-soluble organic solvents is preferably used. It is preferable to adjust the content of water within the ink to be within the range of 20–90 weight %.

As the above-described water-soluble organic solvents, for example, alkyl alcohols having 1–4 carbons, such as methylalcohol and the like, amides, such as dimethylformamide and the like, ketones or ketone alcohols, such as acetone and the like, ethers, such as tetrahydrofuran and the like, polyalkylene glycols, such as polyethylene glycol and the like, alkylene glycols whose alkylene radicals have 2–6 carbons, such as ethylene glycol and the like, lower alkyl ethers of polyhydric alcohols, such as glycerin, ethylene glycol methyl ether and the like, may be used.

From among these water-soluble organic solvents, polyhydric alcohols, such as diethylene glycol and the like, and lower alkyl ethers of polyhydric alcohols, such as triethylene glycol monomethyl ether, triethylene glycol monoethyl ether and the like, are preferable. Polyhydric alcohols are particularly preferable, because they have a great effect as lubricants for preventing clogging of nozzles due to evaporation of water within the ink and deposition of the water-soluble dye.

It is also possible to add a solubilizing agent to the ink. Typical solubilizing agents are nitrogenated heterocyclic ketones. The object of adding a solubilizing agent is to greatly improve the solubility of a water-soluble dye for a solvent. For example, N-methyl-2 pyrolidine and 1, 3-dimethyl-2-imidazolydinone are preferably used. In order to improve characteristics, at least one of the following additives can also be added: a viscosity adjusting agent, a surface-active agent, a surface-tension adjusting agent, a pH adjusting agent, a resistivity adjusting agent and the like.

The image forming method comprises providing the above-described recording medium with ink droplets, preferably by means of the ink-jet recording method. Any method may be used as the ink-jet recording method, provided that ink is effectively discharged from nozzles to provide the recording medium with the ink. Particularly, the ink-jet recording method described in Japanese Patent Laid-Open Application (Kokai) No. 54-59936 (1979), in which an abrupt change is produced in the volume of ink by thermal energy, and the ink is discharged from nozzles by the operating force generated by this state change, can be effectively used.

The image forming method may comprise color printing. Color printing may be performed by using three colors of ink, for example, yellow, cyan and magenta, or by using black ink in addition to the three colors of ink.

As a result of comparison with the above-described prior art, the differences between the technique of the present invention and the prior art are as follows.

1. In Japanese Patent Laid-Open Application (Kokai) No. 58-110287 (1983), a recording medium having an ink-receiving layer whose pore-radius distribution has peaks within the range of 0.2–10 μm and at 0.05 μm is disclosed. It is also disclosed that the volume of pores less than or equal to 0.05 μm is more than or equal to 0.2 ml/g. The idea disclosed in this patent application is that printed ink is first absorbed in large pores in a sheet surface, and is then taken into pores less than or equal to 0.05 μm. In cotrast, in the present invention, the ink-receiving layer has internal voids, and pores connected to the surface of the ink-receiving layer while communicating with the voids.

The present invention has two kinds of pores, as in the prior art, but has a different pore structure. In the present invention, since voids within the ink-receiving layer are not connected directly to the surface, they do not appear in the pore-radius distribution. The present invention differs from the prior art in at least the following two ways.

First, only small pores having relatively small radii are connected to the surface of the ink-receiving layer. Printed ink is absorbed by these pores. By making the maximum radius of these pores within the range of 2.0–20.0 nm, the transparency of the ink-receiving layer and the ink-absorbing speed can be improved.

Second, voids having radii larger than the radii of pores are present only within the ink-receiving layer. The voids increase the ink-absorbing speed by communicating with the pores, and rapidly diffuse ink absorbed by the pores in directions within the surface of the ink-receiving layer. Accordingly, even at high-speed superimposed printing, ink can be rapidly absorbed without being influenced by previously printed ink. Furthermore, the shapes of dots made by multicolor printing become uniform irrespective of the order of printing and history of previous recording.

These ideas are not described in the prior art.

2. In Japanese Patent Laid-Open Application (Kokai) No. 55-11829 (1980), a recording medium comprising at least two layers, in which the ink-absorbing property of the uppermost layer is 1.5–5.5 mm/min and the ink-absorbing property of the second layer is 5.5–60.0 mm/min, is disclosed. The idea of this patent application is to obtain high resolution by suppressing the spread of ink droplets on the surface of the recording medium.

On the other hand, in the present invention, the ink-receiving layer has internal voids, and pores connected to the surface of the ink-receiving layer while communicating with the voids. The idea of the present invention is that by increasing both the ink-absorbing speed and the fixing speed of dyes by controlling the radius of pores at the largest peak in the pore-radius distribution to be within the range of 2.0–20.0 nm, printed ink droplets are absorbed and fixed before spreading on the surface of the ink-receiving layer, and the shapes of dots are controlled to obtain high resolution. Furthermore, by further increasing the ink-absorbing speed of the pores by the voids, ink absorbed by the pores is diffused on the surface, so that a decrease in the ink-absorbing speed when performing multiple printing operations can also be prevented.

These ideas are not described in the prior art.

3. In Japanese Patent Laid-Open Application (Kokai) No. 60-245588 (1985), a recording medium using an alumina xerogel having pore radii of 4.0–100.0 nm is disclosed. In Japanese Patent Laid-Open Application (Kokai) No. 2-276670 (1990), a recording medium having an ink-receiving layer which uses a material having the pseudo-boehmite structure and in which the volume of pores having radii of 4.0–10.0 nm is 0.1–0.4 ml/g is disclosed. The idea of these patent applications is to obtain the transparency, the ink-absorbing property, the coloring property, the resolution and the like of the ink-receiving layer by using an alumina hydrate having a specific pore structure.

In the present invention, the ink-receiving layer has voids, and pores which are connected to the surface of the ink-receiving layer while communicating with the voids. The idea of the present invention is to obtain an excellent ink-absorbing speed during high-speed multiple superimposed printing operations and to obtain uniformity in the ink-absorbing property and the shapes of dots.

These ideas are not described in the prior art.

4. In Japanese Patent Laid-Open Application (Kokai) No. 60-61286 (1985), a recording medium having pores formed in the direction of the thickness of an ink-receiving layer and connected to the surface of the ink-receiving layer is disclosed. A method for manufacturing such a recording medium is also disclosed in which a three-dimensional agglomeration stereoscopic structure is formed by providing a coating liquid with structural viscosity (a thixotropic property) by adding a flocculating agent or the like to a dispersion liquid including a pigment. In Japanese Patent Laid-Open Application (Kokai) No. 60-137685 (1985), a recording medium having very small continuous permeable pores having a volume of 30–300% of the volume of the ink-receiving layer is disclosed. A method for forming the very small continuous permeable pores by preparing a dispersion liquid comprising a pigment and a binder using a liquid obtained by emulsifying a liquid, which is insoluble in water and less volatile than water, in water is also disclosed. In Japanese Patent Laid-Open Application (Kokai) No. 62-174182 (1987), a recording medium including a coagulation, having pores having diameters measured by a method of mercury penetration of at least 0.1 $\mu$m, which is obtained by agglomerating components in a dispersion liquid including an inorganic pigment, such as calcium carbonate, kaolin or the like, for example, by means of pH adjustment, heating, cooling, addition of an inorganic or polymeric floccurating agent, is disclosed.

On the other hand, the recording medium of the present invention has the above-described pore structure, and differs from the recording medium of the prior art. The ink-absorbing structure and the like are not described in the prior art.

5. In Japanese Patent Laid-Open Application (Kokai) No. 5-24335 (1993), a recording medium having a porous layer, comprising a binder and a material having the pseudo-boehmite structure 20–100 $\mu$m thick, having an amount of solvent absorption of 5 ml/m$^2$ is disclosed. The idea of this patent application is to control the amount of ink absorption by controlling the thickness of the porous layer having an average pore radius of 1.5–5.0 nm and a volume of pores having an average pore radius of±1 nm of at least 45% of the total volume of pores. On the other hand, the recording medium of the present invention has voids within the ink-receiving layer and pores communicating with them. According to this structure, an excellent ink-absorbing property at high-speed printing and an excellent absorbing property at multiple printing operations are obtained. These ideas are not described in the prior art.

Embodiments

The present invention will now be described in detail by means of illustrative embodiments, although the invention is not limited to these embodiments.

The measurement of various characteristics used in the present invention was made using the following apparatus, inks and methods.

Unless specifically mentioned, parts indicating the compositional ratios of constituents are based on weight.

A: Printing Apparatus

Using an ink-jet printer, including drop-on-demand-type ink-jet heads for four colors, i.e., Y (yellow), M (magenta), C (cyan) and Bk (black) having 128 nozzles at an interval of 16 nozzles per mm, for forming an image by performing scanning in a direction perpendicular to the nozzle array, ink-jet recording was performed by discharging ink, at 30 ng per dot, having the following composition.

If the amount of ink for printing using monocolor ink at 16×16 dots per mm$^2$ is assumed to be 100%, the amount of ink for two-color printing using two types of monocolor ink is 200% because the amount of ink is twice the amount of ink for monocolor printing. Similarly, the amounts of ink for three-color printing and four-color printing are 300% and 400%, respectively. By superimposing the above-described 100–400% printing, printing up to 800% was performed.

B: Ink dyes

Y: C.I. Direct Yellow 86
M: C.I. Acid Red 35
C: C.I. Direct Blue 199
Bk: C.I. Food Black 2

C: Ink composition 1 (monocolor ink)

| | |
|---|---|
| dye | 3 parts |
| diethylene glycol | 5 parts |
| polyethylene glycol | 10 parts |
| water | 82 parts |

D: Ink composition 2 (clear ink)

| | |
|---|---|
| diethylene glycol | 5 parts |
| polyethylene glycol | 10 parts |
| water | 85 parts |

1. Ink-absorbing Time Period, and Amount of Ink Absorption

Using the ink of ink composition 1 with the dye Bk, and discharging ink at 30 ng per dot onto one point of a recording medium by the above-described printing apparatus, a printing operation of 16×16 dots per mm$^2$ (the amount of ink of 100%), and two and three consecutive printing operations of 16×16 dots per mm$^2$ at an interval of 100 msec (the amounts of ink of 200% and 300%) were performed, and the ink-absorbing process of printed portions was recorded on a video tape through a microscope. The ink-absorbing time period was obtained from the number of frames.

Similarly, multicolor solid printing operations from a printing operation of 16×16 dots per mm$^2$ (the amount of ink of 100%) to a printing operation of 32×32 dots per mm$^2$ (the amount of ink of 400%) were performed, and the state of drying of the ink on the surface of the recording medium due to ink absorption immediately after printing was checked by touching recorded portions with a finger.

A state in which ink does not adhere to the finger at the amount of ink of 400%, a state in which ink does not adhere to the finger at the amount of ink of 300%, a state in which ink does not adhere to the finger at the amount of ink of 100%, and a state in which ink adheres to the finger at the amount of ink of 100% are indicated by "AA", "A", "B" and "C", respectively.

2. Diameters of Dots

Using the clear ink of ink composition 2, superimposed printing operations of 16×16 dots per mm$^2$ with an amount of ink of 30 ng per dot (the amount of ink of 100%) were performed 1–3 times at an interval of 100 msec on the recording medium by the above-described apparatus. Then, low-density printing was performed using the ink of ink composition 1 with the dyes Y, M, C and Bk on portions printed using the clear ink, and the ratio of the diameters of dots was obtained. Dots printed on portions where there is no clear ink are defined as first-color dots, and dots printed on 100%, 200% and 300% printed portions using the clear ink are defined as second-color, third-color and fourth-color dots, respectively.

In general, the diameters of the second and subsequent-color dots become greater than the diameters of the first-color dots. Hence, the ratios of the diameters of the second- through fourth-color dots to the diameter of the first-color dots were obtained. The ratios of the diameters of dots were compared with the images of the respective dots, and the ratio of the diameters of dots of 1.0–1.2 was considered to be excellent.

For the respective colors, a state in which the ratios of the diameters of the second- and third-color dots are excellent is indicated by "A". For any color, a state in which the ratio of the diameters of dots only until the second-color dots is excellent is indicated by "B", and a state in which the ratio of the diameter of the second-color dots is not excellent is indicated by "C".

3. Roundness

Using the clear ink of ink composition 2, superimposed printing operations of 16×16 dots per $mm^2$ with an amount of ink of 30 ng per dot (the amount of ink of 100%) were performed 1–3 times at an interval of 100 msec on the recording medium using the above-described apparatus. Then, low-density printing was performed using the ink of ink composition 1 with the dyes Y, M, C and Bk on portions printed using the clear ink, and the ratio of the diameters of dots was obtained. Dots printed on portions where there is no clear ink are defined as first-color dots, and dots printed on 100%, 200% and 300% printed portions using the clear ink are defined as second-color, third-color and fourth-color dots.

The roundness of the printed dots of each color was obtained by the same method as the method described in Japanese Patent Laid-Open Application (Kokai) No. 61-3777 (1986). The roundness becomes 1.0 if a dot is a complete circle, and has a larger value as irregularities at the circumference of the dot are more remarkable. The roundness is compared with the image for dots of various shapes, and a roundness equal to or less than 1.5 is considered to be excellent.

A state in which the roundness of the dot of each color at the amount of ink of 300% is excellent is indicated by "A", a state in which the roundness of the dot of each color at the printed amount of ink of only 100% is excellent is indicated by "B", and a state in which the roundness of the dot of each color at the amount of ink of 100% is not excellent is indicated by "C".

4. Optical Density

The optical density of an image obtained by solid printing with the amount of ink for each color of 100% (a single color) using the ink of composition 1 with each of the dyes Y, M, C and Bk and using the above-described apparatus was evaluated using a Macbeth reflection densitometer RD-918. When forming an ink-receiving layer on a transparent base material, measurement was performed by placing electrophotographic paper EW-500 (made by Canon. Inc.) on the back of the recording medium.

5. Hue of Color-Mixture Portions

Using the ink of ink composition 1 with each of the dyes Y, M, C and Bk and using the above-described apparatus, printing operations of orange (Y+M), green (Y+C), purple (M+C) and black (Y+M+C) were performed with the amount of ink of each color of 100% while changing the order of printing. The difference in hue when the order of printing was changed was visually observed for the surface and the back of the ink-receiving layer.

A state in which there is no difference in hue for at least three colors in color-mixture portions of the above-described four colors is indicated by "A", a state in which no difference in hue for one or two colors in the color-mixture portions is indicated by "B", and a state in which differences are present for the respective colors in the color-mixture portions is indicated by "C".

6. Blurring, Bleeding, Beading and Cissing

Using the ink of ink composition 1 with each of the dyes Y, M, C and Bk and using the above-described apparatus, solid printing operations were performed by changing the amount of ink from 100% (a single color) to 400% (four colors), and blurring, bleeding, beading and cissing were visually observed on the surface and the back of the ink-receiving layer.

A state in which none of the above-described phenomena occurs at an amount of ink of 300% is indicated by "A", a state in which none of the phenomena occurs at an amount of ink of 100% is indicated by "B", and a state in which each of the above-described phenomena occurs at the amount of ink of 100% is indicated by "C".

In the present invention, blurring, bleeding, beading and cissing are defined as follows.

Blurring is a phenomenon in which, when performing solid printing on a certain area, portions colored by a dye become greater than the printed area.

Bleeding is a phenomenon in which blurring is generated at the border of a portion where multicolor solid printing is performed, and dyes are mixed without being fixed.

Beading is a phenomenon which occurs because ink droplets printed on a recording medium agglomerate during the process of absorption or the like to form a large droplet. Beading is visually recognized as an unevenness in color having about the size of a bead.

Cissing indicates a portion which is not colored by a dye in a portion subjected to solid printing.

7. Transparency

Haze in samples obtained by coating an alumuna hydrate on transparent PET (polyethylene terephthalate) films was measured using a haze meter (NDH-1001DP made by Nippon Denshoku Kabushiki Kaisha) according to JIS (Japanese Industrial Standards) K-7105.

8. Cracks

Samples were cut to a size of 297×21.0 mm, and the length of each crack was visually measured. A sample in which there are no cracks having a length equal to or more than 1 mm is indicated by "A", a sample in which there are no cracks having a length equal to or more than 5 mm is indicated by "B", and a sample in which at least one crack having a length more than 5 mm is present is indicated by "C".

9. Curl

Samples were cut to a size of 297×210 mm, each sample was placed on a flat base, and the amount of warping was measured using a height gauge. A sample having warping less than or equal to 1 mm is indicated by "A", a sample having warping more than 1 mm but less than or equal to 3 mm is indicated by "B", and a sample having warping more than 3 mm is indicated by "C".

10. Tack

If the surface of a recording medium is not sticky when touched with a finger, that recording medium is indicated by "A". If the surface of the recording medium is sticky when touched with a finger, that recording medium is indicated by "C".

11. BET Specific Surface Area, Pore-Radius Distribution, the Volume of Pores, and Isothermal-Desorption-Curve Characteristics These items were measured after performing degassing by sufficiently heating the recording medium using the nitrogen adsorption/desorption method.

Measuring apparatus: Omnisorb 360 made by Coulter Corporation.

The BET specific surface area was calculated according to the method of Brunauer et al. (J. Am. Chem. Soc., vol. 60, 309, 1983).

The radius of each pore and the volume of pores were calculated according to the method of Barrett et al. (J. Am. Chem. Soc., vol. 73, 373, 1951).

The volume of pores having radii of 20–200 nm was obtained according to the same method.

The average pore radius was calculated according to the method of Gregg et al. (Adsorption Surface Area and Porosity, Academic Press, 1967).

The half-width of the pore-radius distribution was obtained from the width of pore radii having a frequency half the frequency of the average pore radius in the pore-radius distribution.

The relative pressure difference (ΔP) between adsorption and desorption at an adsorbed amount of gas of 90% of the maximum adsorbed amount of gas was obtained from the isothermal nitrogen adsorption/desorption curve.

12. The Radii and the Volume Ratio of Voids

Thin pieces of an ink-receiving layer were obtained by slicing the recording medium by a microtome. The cross section of the ink-receiving layer is photographed by a tras-mission electron microscope (H-600 made by Hitachi, Ltd.) to a magnification of 200,000, and the radii of voids within the ink-receiving layer were obtained. The areas of voids were obtained from the obtained photograph, the ratio of the areas to the total area of the photograph was obtained, and the volume ratio (%) of the voids was obtained.

13. Amount of Water Absorption/in-Plane Diffusion Coefficient

A recording medium having an ink-receiving layer formed thereon is cut into a square having sides of 100 mm. Ion-exchanged water is dripped little by little onto a central portion of the square, and is absorbed therein by uniformly spreading the water with a spatula at each drip. This operation is repeated until the ion-exchanged water overflows. The ion-exchanged water remaining on the surface of the sample is wiped using a cloth or the like. The amount of water absorption is obtained from the difference in the weight of the recording medium before and after the absorption of the ion-exchanged water.

The amount of absorption at one point of the recording medium is obtained according to the following method, and the ratio of the amount of absorption at the one point of the recording medium to the amount of water absorption of the recording medium is calculated to provide an in-plane diffusion coefficient. In-plane diffusion coefficient=(Amount of absorption at one point)/(amount of water absorption).

A recording medium having an ink-receiving layer formed thereon is cut into a square having sides of 100 mm, and ion-exchanged water is dripped onto a central point little by little and is absorbed therein. At that time, it is necessary to prevent the dripped ion-exchanged water from spreading on the surface of the ink-receiving layer before being absorbed at the dripped point. As in the case of the measurement of the amount of water absorption, this operation is repeated until the ion-exchanged water overflows. The amount of absorption at the one point of the recording medium is obtained from the difference in the weight of the recording medium before and after the absorption of the ion-exchanged water.

14. Spacing and Crystal Thickness of (020) Plane

Sampling cells were used for measuring powders. Each recording medium was measured by placing it on a sample mount.

X-ray diffractometer: RAD-2R made by Rigaku Denki Kabuishiki Kaishi, Target: CuK Optical system: Wide-angle goniometer (including a graphite curved monochrometer), Gonioradius: 185 mm, Slit:

DS 1°, RS 1°, SS 0.15 mm.

Lamp voltage and lamp current of the X-ray source:

40 kV and 30 mA.

Measuring conditions: 2θ−θ method continuous scanning of taking data at every 2θ=0.002°, 2θ=10°−30°, 1°/min.

Spacing (d) was obtained using Bragg's equation $$d=\lambda/2\sin\theta \quad \text{(Equation 1)}$$

The cystal thickness was obtained using Scherrer's equation $$E=0.9\lambda/B\cos\theta \quad \text{(Equation 2)},$$

where λ is the wavelength of X rays, 2θ is the peak diffraction angle, and B is the half-width of the peak.

15. The Shape of Particles

Samples for measurement were prepared by dispersing an alumina hydrate in ion-exchanged water and dripping the liquid onto a corodion film, and were observed under a transmission electron microscope (H-500 made by Hitachi, Ltd.), and the aspect ratio, the vertical/horizontal ratio and the shape of the particles were obtained.

16. Analysis of the Amount of Titanium Dioxide

The content of titanium dioxide was checked by an ICP method (using SPS 4000 made by Seiko Denshi Kabushiki Kaisha) by fusing the alumina hydrate in borate.

The distribution of titanium dioxide was analyzed using ESCA (Model 2803 made by Surface Science Instruments).

The surface of the alumina hydrate was etched by argon ions for 100 seconds and 500 seconds, and the titanium dioxide content was checked.

COMPOSITIONAL EXAMPLE 1 AND 2 OF ALUMINA HYDRATE

An aluminum dodeoxide was manufactured according to the method described in U.S. Pat. No. 4,242,271. The aluminum dodeoxide was subjected to hydrolysis according to the method described in U.S. Pat. No. 4,202,870 to provide an alumina slurry. Water was added to the alumina slurry until the solid component of the alumina hydrate became 7.9 weight %. The pH of the alumina slurry was 9.5. The pH was adjusted by adding a solution of nitric acid of 3.9 weight %.

A colloidal sol of the alumina hydrate was obtained under aging conditions shown in Table 1. The colloidal sol of the alumina hydrate held at a temperature of 120° C. was subjected to spray drying to obtain the alumina hydrate powder. The crystal structure of the alumina hydrate was boehmite, and the particles had a plate-like shape. The properties of the alumina hydrate were measured according to the above-described methods. The results of the mesurements are shown in Table 1.

COMPOSITIONAL EXAMPLES 3 AND 4 OF ALUMINA HYDRATE

An aluminum dodeoxide was manufactured according to the same method as in the case of Compositional Example 1. The aluminum dodeoxide was subjected to electrolysis according to the same method as in the case of Compositional Example 1 to provide an alumina slurry. The aluminum dodeoxide and isopropyl titanium (made by Kishida Kagaku Kabushiki Kaisha) were mixed with a weight mixing ratio of 100:5. An alumina slurry containing titanium dioxide was manufactured by performing hydrolysis according to the same method as in the case of Compositional Example 1 using the above-described alumuna slurry as seed of crystal growth. Water was added until the density of the solid component of the alumina slurry became 7.9 weight %. The pH of the alumina slurry was adjusted to 9.5 by adding a solution of nitric acid of 3.9 weight %.

A colloidal sol of the alumina hydrate was obtained under the aging conditions shown in Table 1. The colloidal sol of the alumina hydrate was subjected to spray drying as in the case of Compositional Example 1 to obtain an alumina hydrate. As in the case of Compositional Example 1, the alumina hydrate has the boehmite structure, and has a plate-like shape. The properties of the alumina hydrate were measured according to the above-described methods.

The results of the measurements are shown in Table 1. Titanium dioxide was present only in the vicinity of the surface.

COMPOSITIONAL EXAMPLE 5 OF ALUMINA HYDRATE

An alumina sol was synthesized according to the method of Comparative Example 1 described in Japanese Patent Laid-Open Application (Kokai) No. 5-32414 (1993). The alumina sol was subjected to spray drying according to the same method as in the case of Compositional Example 1 to obtain an alumina hydrate. The alumina hydrate has the boehmite structure, and has the shape of needle-like particles. The results of measurements are shown in Table 1.

TABLE 1

| Aging conditions, Results of measurement | Compositional Example 1 | Compositional Example 2 | Compositional Example 3 | Compositional Example 4 | Compositional Example 5 |
|---|---|---|---|---|---|
| pH before aging | 6.0 | 7.1 | 6.3 | 6.7 | — |
| Aging temperature (° C.) | 158 | 53.5 | 167 | 53.8 | — |
| Aging time | 4.2 hr | 8.7 days | 4.6 hr | 9.3 days | — |
| Aging apparatus | Autoclave | Oven | Autoclave | Oven | — |
| Content of titanium dioxide (ICP, weight %) | — | — | 0.150 | 0.150 | — |
| Content of titanium dioxide (ESCA, weight %) after surface etching | — | — | 0.110 | 0.110 | — |
| 100 sec | — | — | 0.051 | 0.051 | — |
| 500 sec | — | — | 0.000 | 0.000 | — |
| Particle shape | plate-like | plate-like | plate-like | plate-like | needle-like |
| Average particle size (nm) | 27.2 | 30.1 | 24.6 | 26.5 | 20.0 |
| Aspect ratio | 6.4 | 8.6 | 5.7 | 8.1 | 3.0 |
| Spacing (nm) | 0.618 | 0.619 | 0.618 | 0.619 | 0.619 |
| Diameter of crystal (nm) | 7.5 | 7.3 | 7.4 | 7.4 | 6.7 |

EXAMPLE 1

A dispersion liquid A having a solid-component density of 15 weight % was made by dispersing the alumina hydrate powder of Compositional Example 1 in ion-exchanged water. Sodium chloride (made by Kishida Kagaku Kabushiki Kaisha) was added to this alumina-hydrate dispersion liquid A by an amount of 1/150 (by weight) of the amount of the solid component of the alumina hydrate. The obtained liquid was stirred by a homomixer (made by Tokushu Kika Kabushiki Kaisha) at 2000 rpm for 5 minutes to obtain a dispersion liquid B. Separately, polyvinyl alcohol (Gohsenol NH18 made by the Nippon Synthetic Chemical Industry Co., Ltd.) was dissolved and dispersed in ion-exchanged water in the same manner to obtain a dispersion liquid C having a solid-component density of 10 weight %.

The alumina-hydrate dispersion liquid B and the polyvinyl-alcohol dispersion liquid C were mixed with a weight mixing ratio of 1:10 between the polyvinyl-alcohol solid component and the alumina-hydrate solid component, and the resultant liquid was stirred by a homomixer at 8000 rpm for 10 minutes to obtain a mixed dispersion liquid D. The mixed dispersion liquid D was coated on a transparent PET film ("Lumilar" made by Toray Industries, Inc.) having a thickness of 100 $\mu$m. The PET film on which the dispersion liquid was coated was placed in an oven (made by Yamato Kagaku Kabushiki Kaisha), and the vicinity of the surface of the coated layer was rapidly dried by heating the film at 100° C. for 5 minutes. The film was further dried in the same oven by raising the temperature to 120° C., and a recording medium having an ink-receiving layer 30 $\mu$m thick formed thereon was obtained. Thereafter, the medium was heated in the same oven at 120° C. for 10 minutes.

The properties of the recording medium were measured according to the above-described methods.

The results of the measurements are shown in Table 2.

EXAMPLE 2

Polyethylene imine (made by Kishida Kagaku Kabushiki Kaisha), serving as a cationic polymeric electrolyte, was added to the same alumuna-hydrate dispersion liquid A of Compositional Example 1 as in the case of Example 1 at an amount of 2/100 of the amount of the solid component of the alumina hydrate. This dispersion liquid was stirred by the same apparatus and method as in the case of Example 1 to obtain a dispersion liquid B1. A recording medium was obtained in the same manner as in Example 1, except that the above-described dispersion liquid B1 was used instead of the dispersion liquid B in Example 1.

The properties of the recording medium were measured according to the above-described methods.

The results of the measurements are shown in Table 2.

EXAMPLE 3

Methylvinyl ether-maleic anhydride (made by GAF Corp.), serving as a cationic macromolecular electrolyte, was added to the same alumuna-hydrate dispersion liquid A of Compositional Example 1 as in the case of Example 1 at an amount of 2/100 of the amount of the solid component of the alumina hydrate. This dispersion liquid was stirred by the same apparatus and method as in the case of Example 1 to obtain a dispersion liquid B2. A recording medium was obtained in the same manner as in the case of Example 1, except that the above-described dispersion liquid B2 was used instead of the dispersion liquid B in Example 1.

The properties of the recording medium were measured according to the above-described methods.

The results of the measurements are shown in Table 2.

EXAMPLE 4

A colloidal sol of the alumina hydrate of Compositional Example 1 was heated and dried using a hot-air-circulating drying furnace (made by Satake Kabushiki Kaisha) at 170° C. to obtain a xerogel of the alumina hydrate. The xerogel of the alumina hydrate was pulverized by a vibrating ball mill (made by Irie Shokai) using glass beads. After removing particles greater than or equal to 20 μm by performing classifieation, ion-exchanged water was added to obtain an altumina-hydrate dispersion liquid having a solid-component density of 15 weight %. The liquid was stirred by the same apparatus and method as in the case of Example 1 to obtain a dispersion liquid B3.

A recording medium was obtained in the same manner as in the case of Example 1, except that the dispersion liquid B3 was used instead of the dispersion liquid B in Example 1.

The properties of the recording medium were measured according to the above-described methods.

The results of the measurements are shown in Table 2.

TABLE 2

| Manufacturing conditions, Measureed items<br>Alumina hydrate | Example 1 Compositional Example 1 | Example 2 Compositional Example 1 | Example 3 Compositional Example 1 | Example 4 Compositional Example 1 |
|---|---|---|---|---|
| Spacing (nm) (020) plane | 0.618 | 0.618 | 0.618 | 0.618 |
| Diameter of crystal (nm) (020) plane | 7.5 | 7.5 | 7.5 | 7.5 |
| BET specific surface area ($m^2/g$) | 230 | 228 | 235 | 231 |
| Average pore radius (nm) | 6.7 | 7.1 | 7.3 | 6.8 |
| Half-width (nm) | 5.0 | 5.0 | 5.0 | 5.0 |
| Maximum 1 in pore distribution (nm) | 7.0 | 7.0 | 7.0 | 7.0 |
| Maximum 2 in pore distribution (nm) | — | — | — | — |
| Volume of pores | | | | |
| (ml/g) | 0.60 | 0.60 | 0.60 | 0.60 |
| ($ml/m^2$) | 22.7 | 27.6 | 26.3 | 27.7 |
| Volume ratio of pores having radii 2.0–20.0 nm (%) | 90 | 90 | 90 | 90 |
| Volume ratio of pores at maximum 2 (%) | — | — | — | — |
| Relative pressure difference (ΔP) | 0.04 | 0.04 | 0.04 | 0.04 |
| Radii of internal voids (nm) | 50.0–150.0 | 50.0–150.0 | 50.0–150.0 | 50.0–150 |
| Amount of water absorption (ml/g) | 0.66 | 0.63 | 0.64 | 0.65 |
| Amount of water absorption ($ml/m^2$) | 25.0 | 29.0 | 28.0 | 30.0 |
| Volume ratio of voids (%) | 3 | 2 | 5 | 4 |
| In-plane diffusion coefficient | 0.9 | 0.8 | 1.0 | 0.8 |
| Ink-absorbing time period (msec) | | | | |
| (100%) | 200 | 200 | 200 | 200 |
| (200%) | 400 | 400 | 400 | 400 |
| (300%) | 800 | 800 | 800 | 800 |
| Amount of ink absorption | AA | AA | AA | AA |
| Dot diameter | A | A | A | A |
| Roundness | A | A | A | A |
| Optical density (ink-absorbing-layer side) | | | | |
| (Y) | 1.99 | 1.95 | 1.91 | 1.94 |
| (M) | 1.91 | 1.93 | 1.99 | 1.99 |
| (C) | 1.95 | 1.88 | 1.97 | 1.91 |
| (Bk) | 2.00 | 1.99 | 2.05 | 1.97 |
| Hue of color-mixture portion | A | A | A | A |
| Blurring | A | A | A | A |
| Bleeding | A | A | A | A |
| Beading | A | A | A | A |
| Cissing | A | A | A | A |
| Haze (transparency) | 5.1 | 5.0 | 5.0 | 4.9 |
| Cracks | A | A | A | A |
| Curl | A | A | A | A |
| Tack | A | A | A | A |

EXAMPLE 5

A dispersion liquid having a solid-component density of 15 weight % of the alumina hydrate of Compositional Example 1 was provided according to the same method as in Example 1. This dispersion liquid was stirred by a paint shaker (made by Red Devil Corp.) for 10 minutes to obtain a dispersion liquid B4.

A recording medium was obtained in the same manner as in the case of Example 1, except that the dispersion liquid B4 was used instead of the dispersion liquid B in Example 1.

The properties of the recording medium were measured according to the above-described methods.

The results of the measurements are shown in Table 3.

EXAMPLE 6

Ethylene glycol (made by Kishida Kagaku Kabushi Kaisha) at an amount of 5/100 of the total amount of the colloidal sol of the alumina hydrate of Compositional Example 1 was added to the colloidal sol, and the obtained liquid was stirred according to the same method as in the case of Example 1. The sol held at a temperature of 145° C. was dried by the above-described spray drier to obtain a xerogel. Ion-exchanged water was added to the xerogel to obtain an alumina-hydrate dispersion liquid having a solid-component density of 15 weight %. The dispersion liquid was stirred by the same apparatus and method as in the case of Example 1 to obtain a dispersion liquid B5.

A recording medium was obtained in the same manner as in the case of Example 1, except that the dispersion liquid B5 was used instead of the dispersion liquid B in Example 1.

The properties of the recording medium were measured according to the above-described methods.

The results of the measurements are shown in Table 3.

EXAMPLE 7

A hydrogen cake obtained by passing the colloidal sol of the alumina hydrate of Compositional Example 1 through an ion-exchange membrane was washed using ion-exchanged water. After adding ion-exchanged water having an amount of 15 weight % of the solid-component density to the hydrogel cake, the obtained liquid was stirred by the same apparatus as in Example 1 to obtain a dispersion liquid B6.

A recording medium was obtained in the same manner as in Example 1, except that the dispersion liquid B6 was used instead of the dispersion liquid B in Example 1.

The properties of the recording medium were measured according to the above-described methods.

The results of the measurements are shown in Table 3.

EXAMPLE 8

A special-reaction-system aldehyde resin (Sumirez Resin 5004 made by Sumitomo Chemical Company, Ltd.) was added to the mixed dispersion liquid D of Example 1 in an amount of 5 weight % of the amount of the solid component of the above-described mixed dispersion liquid. The resultant liquid was stirred by the same apparatus and method as in Example 1 to obtain a dispersion liquid E for coating. The dispersion liquid E was coated on the same film base material as in Example 1 by the same apparatus and method as in Example 1. The coated base material was heated and dried by the same apparatus as in Example 1 at 100° C. for 10 minutes to obtain a recording medium having an ink-receiving layer 30 $\mu$m thick formed thereon. Thereafter, the recording medium was heated according to the same method as in Example 1.

The properties of the recording medium were measured according to the above-described methods.

The results of the measurements are shown in Table 3.

TABLE 3

| Manufacturing conditions, Measured items<br>Alumina hydrate | Example 5<br>Compositional Example 1 | Example 6<br>Compositional Example 1 | Example 7<br>Compositional Example 1 | Example 8<br>Compositional Example 1 |
|---|---|---|---|---|
| Spacing (nm) (020) plane | 0.618 | 0.618 | 0.618 | 0.618 |
| Diameter of crystal (nm) (020) plane | 7.5 | 7.5 | 7.5 | 7.5 |
| BET specific surface area ($m^2/g$) | 233 | 227 | 229 | 232 |
| Average pore radius (nm) | 6.7 | 6.7 | 6.7 | 6.9 |
| Half-width (nm) | 5.0 | 5.0 | 5.0 | 5.0 |
| Maximum 1 in pore distribution (nm) | 6.8 | 7.1 | 6.8 | 6.9 |
| Maximum 2 in pore distribution (nm) | — | — | — | — |
| Volume of pores | | | | |
| (ml/g) | 0.60 | 0.60 | 0.60 | 0.60 |
| ($ml/m^2$) | 28.1 | 25.7 | 26.8 | 24.8 |
| Volume ratio of pores having radii 2.0–20.0 nm (%) | 90 | 90 | 90 | 90 |
| Volume ratio of pores at maximum 2 (%) | — | — | — | — |
| Relative pressure difference (ΔP) | 0.04 | 0.04 | 0.04 | 0.04 |
| Radii of internal voids (nm) | 50.0–150.0 | 50.0–150.0 | 50.0–150.0 | 50.0–150.0 |
| Amount of water absorption (ml/g) | 0.64 | 0.63 | 0.65 | 0.63 |
| Amount of water absorption ($ml/m^2$) | 30.0 | 27.0 | 29.0 | 26.0 |

TABLE 3-continued

| Manufacturing conditions, Measured items<br>Alumina hydrate | Example 5<br>Compositional Example 1 | Example 6<br>Compositional Example 1 | Example 7<br>Compositional Example 1 | Example 8<br>Compositional Example 1 |
|---|---|---|---|---|
| Volume ratio of voids (%) | 4 | 3 | 2 | 4 |
| In-plane diffusion coefficient | 1.0 | 0.9 | 0.8 | 0.8 |
| Ink-absorbing time period (msec) | | | | |
| (100%) | 200 | 200 | 200 | 200 |
| (200%) | 400 | 400 | 400 | 400 |
| (300%) | 800 | 800 | 1000 | 1000 |
| Amount of ink absorption | AA | AA | AA | AA |
| Dot diameter | A | A | A | A |
| Roundness | A | A | A | A |
| Optical density (ink-absorbing-layer side) | | | | |
| (Y) | 1.94 | 1.95 | 1.93 | 1.91 |
| (M) | 1.88 | 1.99 | 1.95 | 1.99 |
| (C) | 1.95 | 1.97 | 1.91 | 1.91 |
| (Bk) | 2.02 | 2.03 | 1.99 | 1.92 |
| Hue of color-mixture portion | A | A | A | A |
| Blurring | A | A | A | A |
| Bleeding | A | A | A | A |
| Beading | A | A | A | A |
| Cissing | A | A | A | A |
| Haze (transparency) | 4.8 | 5.2 | 5.2 | 4.7 |
| Cracks | A | A | A | A |
| Curl | A | A | A | A |
| Tack | A | A | A | A |

EXAMPLE 9

Polyvinyl alcohol having a large molecular weight (PVA124H made by Kuraray Co., Ltd.) was dissolved and dispersed in ion-exchanged water to obtain a solution having a solid-component density of 10 weight %. The dispersion liquid B of Example 1 was mixed with this polyvinyl-alcohol dispersion liquid C1 with the same mixing ratio of the solid components as in Example 1, and a reaction-system resin (Sumirez Resin 802 made by Sumitomo Chemical Company, Ltd.) was also added in an amount of 5 weight % of the amount of the solid component of the above-described dispersion liquid. The obtained liquid was stirred by the same method as in Example 1 to obtain a dispersion liquid F for coating. The dispersion liquid F was coated on the same film base material as in Example 1 by the same apparatus and method as in Example 1. The coated base material was heated and dried by the same apparatus as in Example 1 at 100° C. for 10 minutes to obtain a recording medium having an ink-receiving layer 30 μm thick formed thereon. Thereafter, the recording medium was heated according to the same method as in Example 1.

The properties of the recording medium were measured according to the above-described methods.

The results of the measurements are shown in Table 4.

EXAMPLE 10

The polyvinyl-alcohol dispersion liquid C of Example 1 and the polyvinyl-alcohol dispersion liquid C1 of Example 9 were mixed with a mixing ratio of the solid components of 1:1, and the obtained liquid was stirred according to the same method as in Example 1 to obtain a polyvinyl-alcohol mixed dispersion liquid. The dispersion liquid B of alumina hydrate including sodium chloride added thereto of Example 1 was mixed with this polyvinyl-alcohol mixed dispersion liquid with the same mixing ratio of the solid components as in Example 1, and a polyamide-type resin (Sumirez Resin 5001 made by Sumitomo Chemical Company, Ltd.) was also added in an amount of 5 weight % of the amount of the solid component of the above-described mixed dispersion liquid. The obtained liquid was stirred according to the same method as in Example 1 to obtain a dispersion liquid G for coating. This dispersion liquid was coated on the same film base material as in Example 1 by the same apparatus and method as in Example 1. The coated base material was heated and dried by the same apparatus as in Example 1 at 100° C. for 10 minutes to obtain a recording medium having an ink-receiving layer 30 μm thick formed thereon. Then, the recording medium was heated according to the same method as in Example 1.

The properties of the recording medium were measured according to the above-described methods.

The results of the measurements are shown in Table 4.

EXAMPLE 11

Ion-exchanged water and dimethylformamide (made by Kishida Kagaku Kabushi Kaisha) were mixed with a mixing ratio of 8:2 to obtain a mixed solvent "a". The alumina hydrate powder of Compositional Example 1 was dispersed in this mixed solvent to obtain a dispersion liquid having a solid-component density of 15 weight %. The same polyvinyl-alcohol dispersion liquid C as that of Example 1 was mixed with this mixed dispersion liquid in the same mixing ratio of the solid components as in Example 1. The obtained liquid was stirred by the same apparatus and method as in Example 1 to obtain a dispersion liquid H for coating. This dispersion liquid H was coated on the same film base material as in Example 1 by the same apparatus and method as in Example 1. The coated base material was heated and dried by the same apparatus as in Example 1 at 100° C. for 10 minutes to obtain a recording medium having an ink-receiving layer 30 μm thick formed thereon. Then, the recording medium was heated according to the same method as in Example 1.

The properties of the recording medium were measured according to the above-described methods.

The results of the measurements are shown in Table 4.

EXAMPLE 12

A recording medium was obtained in the same manner as in the case of Example 11, except that the mixed solvent "a" of Example 11 was replaced by a mixed solvent "b" obtained by mixing ion-exchanged water and ethyl cellosolve (made by Kishida Kagaku Kabushiki Kaisha) in a mixing ratio of 8:2.

The properties of the recording medium were measured according to the above-described methods.

The results of the measurements are shown in Table 4.

TABLE 4

| Manufacturing conditions, Measured items<br>Alumina hydrate | Example 9<br>Compositional Example 1 | Example 10<br>Compositional Example 1 | Example 11<br>Compositional Example 1 | Example 12<br>Compositional Example 1 |
|---|---|---|---|---|
| Spacing (nm) (020) plane | 0.618 | 0.618 | 0.618 | 0.618 |
| Diameter of crystal (nm) (020) plane | 7.5 | 7.5 | 7.5 | 7.5 |
| BET specific surface area ($m^2/g$) | 230 | 230 | 230 | 230 |
| Average pore radius (nm) | 6.9 | 6.8 | 7.0 | 6.9 |
| Half-width (nm) | 5.0 | 5.0 | 5.0 | 5.0 |
| Maximum 1 in pore distribution (nm) | 7.1 | 6.9 | 7.1 | 7.2 |
| Maximum 2 in pore distribution (nm) | — | — | — | — |
| Volume of pores | | | | |
| (ml/g) | 0.60 | 0.60 | 0.60 | 0.60 |
| ($ml/m^2$) | 25.3 | 26.3 | 25.7 | 27.6 |
| Volume ratio of pores having radii 2.0–20.0 nm (%) | 90 | 90 | 90 | 90 |
| Volume ratio of pores at maximum 2 (%) | — | — | — | — |
| Relative pressure difference (ΔP) | 0.04 | 0.04 | 0.04 | 0.04 |
| Radii of internal voids (nm) | 50.0–150.0 | 50.0–150.0 | 50.0–150.0 | 50.0–150.0 |
| Amount of water absorption (ml/g) | 0.64 | 0.64 | 0.63 | 0.63 |
| Amount of water absorption ($ml/m^2$) | 27.0 | 28.0 | 27.0 | 29.0 |
| Volume ratio of voids (%) | 5 | 4 | 4 | 5 |
| In-plane diffusion coefficient | 0.9 | 0.8 | 0.9 | 1.0 |
| Ink-absorbing time period (msec) | | | | |
| (100%) | 200 | 200 | 200 | 200 |
| (200%) | 400 | 400 | 400 | 400 |
| (300%) | 800 | 1000 | 800 | 1000 |
| Amount of ink absorption | AA | AA | AA | AA |
| Dot diameter | A | A | A | A |
| Roundness | A | A | A | A |
| Optical density (ink-absorbing-layer side) | | | | |
| (Y) | 1.91 | 1.90 | 1.98 | 1.90 |
| (M) | 1.91 | 1.93 | 1.95 | 1.90 |
| (C) | 1.95 | 1.95 | 1.97 | 1.97 |
| (Bk) | 1.91 | 2.01 | 1.91 | 2.00 |
| Hue of color-mixture portion | A | A | A | A |
| Blurring | A | A | A | A |
| Bleeding | A | A | A | A |
| Beading | A | A | A | A |
| Cissing | A | A | A | A |
| Haze (transparency) | 4.7 | 5.0 | 4.5 | 5.0 |
| Cracks | A | A | A | A |
| Curl | A | A | A | A |
| Tack | A | A | A | A |

EXAMPLE 13

The mixed dispersion liquid D of Example 1 is designated dispersion liquid 1 for coating, and a dispersion liquid obtained by omitting sodium chloride from the mixed dispersion liquid D of Example 1 is designated dispersion liquid 2.

The dispersion liquid 1 was coated on the same film base material as in Example 1 by the same apparatus as in Example 1, and the coated base material was heated by the same apparatus as in Example 1 at 100° C. for one minute. Then, the dispersion liquid 2 was coated by the same apparatus by an amount of 1/20 of the dispersion liquid 1, and the coated base material was heated and dried at 100° C. for 10 minutes to obtain a recording medium having an ink-receiving layer 30 μm thick formed thereon. Then, the recording medium was heated according to the same method as in Example 1.

The properties of the recording medium were measured according to the above-described methods.

The results of the measurements are shown in Table 5.

EXAMPLE 14

A dispersion liquid obtained by dispersing an alumina hydrate, and the same polyvinyl-alcohol dispersion liquid as that of Example 1 were mixed with the same mixed solvent comprising ion-exchanged water and dimethylformamide as in Example 11 in the same ratio as in Example 11. A melamine-type resin (Sumirez Resin 613S made by Sumitomo Chemical Company, Ltd.) was also added in an amount of 5 weight % of the amount of the solid components of the alumina hydrate and polyvinyl alcohol. The obtained liquid was stirred by the same apparatus and method as in Example 1 to obtain a dispersion liquid for coating. This dispersion liquid was coated and dried according to the same method as in Example 11 to obtain a recording medium having an ink-receiving layer 30 μm thick formed thereon. Then, the recording medium was heated according to the same method as in Example 1.

The properties of the recording medium were measured according to the above-described methods.

The results of the measurements are shown in Table 5.

EXAMPLE 15

A recording medium was obtained in the same manner as in Example 1, except that the alumina hydrate of Compositional Example 2 was used instead of the alumina hydrate of Compositional Example 1 in Example 1.

The properties of the recording medium were measured according to the above-described methods.

The results of the measurements are shown in Table 5.

EXAMPLE 16

A recording medium was obtained in the same manner as in Example 1, except that the alumina hydrate of Compositional Example 3 was used instead of the alumina hydrate of Compositional Example 1 in Example 1.

The properties of the recording medium were measured according to the above-described methods.

The results of the measurements are shown in Table 5.

TABLE 5

| Manufacturing conditions, Measured items<br>Alumina hydrate | Example 13<br>Compositional Example 1 | Example 14<br>Compositional Example 1 | Example 15<br>Compositional Example 2 | Example 16<br>Compositional Example 3 |
|---|---|---|---|---|
| Spacing (nm) (020) plane | 0.618 | 0.618 | 0.619 | 0.618 |
| Diameter of crystal (nm) (020) plane | 7.5 | 7.5 | 7.3 | 7.4 |
| BET specific surface area ($m^2/g$) | 230 | 215 | 210 | 230 |
| Average pore radius (nm) | 7.1 | 6.7 | 8.4 | 6.5 |
| Half-width (nm) | 5.0 | 5.3 | 5.1 | 3.0 |
| Maximum 1 in pore distribution (nm) | 7.2 | 6.7 | 10.0 | 6.5 |
| Maximum 2 in pore distribution (nm) | — | — | 2.5 | — |
| Volume of pores | | | | |
| (ml/g) | 0.60 | 0.60 | 0.60 | 0.60 |
| ($ml/m^2$) | 24.9 | 23.1 | 26.4 | 25.4 |
| Volume ratio of pores having radii 2.0–20.0 nm (%) | 90 | 90 | 90 | 90 |
| Volume ratio of pores at maximum 2 (%) | — | — | 5 | — |
| Relative pressure difference (ΔP) | 0.04 | 0.04 | 0.03 | 0.03 |
| Radii of internal voids (nm) | 50.0–150.0 | 50.0–150.0 | 50.0–150.0 | 50.0–150.0 |
| Amount of water absorption (ml/g) | 0.65 | 0.65 | 0.66 | 0.65 |
| Amount of water absoprtion ($ml/m^2$) | 27.0 | 25.0 | 29.0 | 27.5 |
| Volume ratio of voids (%) | 4 | 3 | 4 | 5 |
| In-plane diffusion coefficient | 1.0 | 0.9 | 0.9 | 0.9 |

TABLE 5-continued

| Manufacturing conditions, Measured items<br>Alumina hydrate | Example 13 Compositional Example 1 | Example 14 Compositional Example 1 | Example 15 Compositional Example 2 | Example 16 Compositional Example 3 |
|---|---|---|---|---|
| Ink-absorbing time period (msec) | | | | |
| (100%) | 200 | 200 | 200 | 200 |
| (200%) | 400 | 400 | 400 | 400 |
| (300%) | 800 | 1000 | 800 | 800 |
| Amount of ink absorption | A | A | A | A |
| Dot diameter | A | A | A | A |
| Roundness | A | A | A | A |
| Optical density (ink-absorbing-layer side) | | | | |
| (Y) | 2.00 | 1.99 | 2.00 | 2.15 |
| (M) | 1.96 | 1.93 | 1.97 | 2.15 |
| (C) | 2.00 | 2.00 | 2.00 | 2.14 |
| (Bk) | 1.92 | 1.91 | 1.99 | 2.09 |
| Hue of color-mixture portion | A | A | A | A |
| Blurring | A | A | A | A |
| Bleeding | A | A | A | A |
| Beading | A | A | A | A |
| Cissing | A | A | A | A |
| Haze (transparency) | 5.0 | 4.8 | 4.9 | 4.9 |
| Cracks | A | A | A | A |
| Curl | A | A | A | A |
| Tack | A | A | A | A |

EXAMPLE 17

A recording medium was obtained in the same manner as in Example 1, except that the alumina hydrate of Compositional Example 4 was used instead of the alumina hydrate of Compositional Example 1 in Example 1.

The properties of the recording medium were measured according to the above-described methods.

The results of the measurements are shown in Table 6.

EXAMPLE 18

A recording medium was obtained in the same manner as in Example 1, except that the alumina hydrate of Compositional Example 5 was used instead of the alumina hydrate of Compositional Example 1 in Example 1.

The properties of the recording medium were measured according to the above-described methods.

The results of the measurements are shown in Table 6.

TABLE 6

| Manufacturing conditions, Measured items<br>Alumina hydrate | Example 17 Compositional Example 4 | Example 18 Compositional Example 5 |
|---|---|---|
| Spacing (nm) (020) plane | 0.619 | 0.619 |
| Diameter of crystal (nm) (020) plane | 7.4 | 6.7 |
| BET specific surface area ($m^2/g$) | 220 | 250 |
| Average pore radius (nm) | 8.4 | 6.0 |
| Half-width (nm) | 5.0 | 2.2 |
| Maximum 1 in pore distribution (nm) | 10.0 | 6.0 |
| Maximum 2 in pore distribution (nm) | 2.5 | — |

TABLE 6-continued

| Manufacturing conditions, Measured items<br>Alumina hydrate | Example 17 Compositional Example 4 | Example 18 Compositional Example 5 |
|---|---|---|
| Volume of pores | | |
| (ml/g) | 0.60 | 0.55 |
| ($ml/m^2$) | 24.9 | 25.9 |
| Volume ratio of pores having radii 2.0–20.0 nm (%) | 90 | 96 |
| Volume ratio of pores at maximum 2 (%) | 5 | — |
| Relative pressure difference (ΔP) | 0.04 | 0.04 |
| Radii of internal voids (nm) | 50.0–150.0 | 50.0–150.0 |
| Amount of water absorption ($ml/m^2$) | 0.65 | 0.65 |
| Amount of water absoprtion (ml/g) | 27.0 | 28.0 |
| Volume ratio of voids (%) | 4 | 5 |
| In-plane diffusion coefficient | 1.0 | 0.8 |
| Ink-absorbing time period (msec) | | |
| (100%) | 200 | 200 |
| (200%) | 400 | 400 |
| (300%) | 800 | 800 |
| Amount of ink absorption | AA | AA |
| Dot diameter | A | A |
| Roundness | A | A |
| Optical density (ink-absorbing-layer side) | | |
| (Y) | 2.11 | 1.98 |
| (M) | 2.14 | 1.98 |
| (C) | 2.13 | 1.97 |
| (Bk) | 2.19 | 2.00 |
| Hue of color- | A | A |

TABLE 6-continued

| Manufacturing conditions, Measured items<br>Alumina hydrate | Example 17 Compositional Example 4 | Example 18 Compositional Example 5 |
|---|---|---|
| mixture portion | | |
| Blurring | A | A |
| Bleeding | A | A |
| Beading | A | A |
| Cissing | A | A |
| Haze (transparency) | 4.5 | 4.7 |
| Cracks | A | A |
| Curl | A | A |
| Tack | A | A |

By using the recording medium and the image forming method of the present invention, the following superior results can be obtained.

(1) Because of the structure of having voids within an ink-receiving layer and having pores connected to the surface of the ink-receiving layer while communicating with the voids, a decrease in the ink-absorbing speed during printing operations of second and subsequent colors can be prevented, even if multiple printing operations are repeatedly performed at a high speed. In addition, since the solvent component of the absorbed ink can be rapidly diffused within the surface, the size and the shape of the dots of each color become uniform irrespective of the order of printing, and the hue in color-mixture portions becomes uniform.

(2) By making the maximum radius of pores connected to the surface of the ink-receiving layer 2.0–20.0 nm, and by making the volume of pores within this range at least 80% of the total volume of pores, it is possible to improve the transparency of the ink-receiving layer and to increase the ink-absorbing speed and the fixing speed of ink dyes. Hence, the roundness of printed dots can be improved. In addition, the shape and the size of dots of each color become uniform, irrespective of the order of printing, even if multiple printing operations are performed. Particularly, since the hue of color-mixture portions becomes deeper as the amount of printed ink increases, excellent color reproducibility is obtained.

(3) By making the amount of water absorption of the recording medium 0.4–1.0 ml/g and by making the in-plane diffusion coefficient 0.7–1.0, ink overflow can be prevented even if a large amount of ink is printed at a high speed.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording medium comprising:

a porous ink-receiving layer having a surface, and comprising an alumina hydrate having a boehmite structure, and a binder, wherein said ink-receiving layer contains voids having radii and which communicate with the surface of said ink-receiving layer through pores having radii smaller than the radii of the voids.

2. A recording medium according to claim 1, wherein the radii of the voids are at least 1.5 times of the radii of the pores.

3. A recording medium according to claim 1, wherein the distribution of the radii of the pores has its largest peak within the range of 2.0–20.0 nm.

4. A recording medium according to claim 1, wherein the radii of the voids are within the range of 50.0–200.0 nm.

5. A recording medium according to claim 1, wherein the pores of said ink-receiving layer have a volume within the range of 0.4–1.0 ml/g.

6. A recording medium according to claim 1, where the pores of said ink-receiving layer have a volume within the range of 0.4–0.6 ml/g.

7. A recording medium according to claim 1, wherein pores having radii of 2.0–20.0 nm make up at least 80% by volume of all pores in the ink-receiving layer.

8. A recording medium according to claim 1, wherein the voids make up between 1 to 10% of said ink-receiving layer, by volume.

9. A recording medium according to claim 1, wherein the amount of water absorption of said ink-receiving layer is within the range of 0.4–1.0 ml/g.

10. A recording medium according to claim 1, wherein the in-plane diffusion coefficient of said ink-receiving layer is within the range of 0.7–1.0.

11. A recording medium according to claim 1, wherein the ink-absorbing time period of said ink-receiving layer, when performing printing with 30 ng of ink at a density of 16×16 dots per $mm^2$, is less than or equal to 400 msec.

12. A recording medium according to claim 1, wherein the ink-absorbing time period of said ink-receiving layer, when performing two consecutive printing operations with 30 ng of ink at a density of 16×16 dots per $mm^2$ with an interval of 100 msec, is less than or equal to 600 msec.

13. A recording medium according to claim 1, wherein the ink-absorbing time period of said ink-receiving layer, when performing three consecutive printing operations with 30 ng of ink at a density of 16×16 dots per $mm^2$ with an interval of 100 msec, is less than or equal to 1200 msec.

14. An image forming method comprising the steps of:

providing the recording medium described in any one of claims 1–13, and supplying ink droplets to said recording medium.

15. An image forming method according to claim 14, wherein said ink is supplied by an ink-jet method.

16. An image forming method according to claim 15, wherein said ink-jet method comprises a method of discharging ink droplets by applying thermal energy to the ink.

17. An image forming method according to claim 14, wherein color printing is performed using three color inks, which are yellow, cyan and magenta.

18. An image forming method according to claim 17, wherein black ink is used in addition to the three color inks.

* * * * *

UNITED STATES PATENT AND TRADEMARK OFFICE

CERTIFICATE OF CORRECTION

PATENT NO. : 5,955,185

DATED : September 21, 1999

INVENTOR(S) : HITOSHI YOSHINO, ET AL.

It is certified that error appears in the above-identified patent and that said Letters Patent is hereby corrected as shown below:

ON THE COVER PAGE:

Item [56] References Cited - OTHER PUBLICATIONS

After "E.P. Barrett, et al.," "vo. LXXII," should read --vol. LXXIII,--.

COLUMN 6:

Line 14, "phosphorous," should read --phosphorus--.
Line 23, "transparent" should read --transmission--.

COLUMN 8:

Line 7, "ml/$M^2$" should read --ml/$m^2$--.

COLUMN 12:

Line 49, "ative" should read --active--.

UNITED STATES PATENT AND TRADEMARK OFFICE

CERTIFICATE OF CORRECTION

PATENT NO. : 5,955,185

DATED : September 21, 1999

INVENTOR(S) : HITOSHI YOSHINO, ET AL.

It is certified that error appears in the above-identified patent and that said Letters Patent is hereby corrected as shown below:

COLUMN 17:

Line 54, "cotrast," should read --contrast,--.

COLUMN 21:

Line 55, "which" should read --which there is--.

COLUMN 22:

Line 23, "alumuna" should read --alumina--.
Line 29, "21.0 mm," should read --210 mm,--.

COLUMN 23:

Line 13, "tras-mission" should read --transmission--.
Line 57, "CuK" should read --$CuK_{\alpha}$--.

COLUMN 24:

Line 61, "alumuna" should read --alumina--.

UNITED STATES PATENT AND TRADEMARK OFFICE

CERTIFICATE OF CORRECTION

PATENT NO. : 5,955,185

DATED : September 21, 1999

INVENTOR(S) : HITOSHI YOSHINO, ET AL.

It is certified that error appears in the above-identified patent and that said Letters Patent is hereby corrected as shown below:

COLUMN 26:

Line 15, "alumuna-hydrate" should read --alumina-hydrate--.

Line 56, "alumuna-hydrate" should read --alumina-hydrate--.

COLUMN 28:

TABLE 2, Line 15, "Measureed" should read --Measured--.

Signed and Sealed this

First Day of May, 2001

*Attest:*

Nicholas P. Godici

NICHOLAS P. GODICI

*Attesting Officer*

*Acting Director of the United States Patent and Trademark Office*